US010982459B2

(12) United States Patent
Mousavi et al.

(10) Patent No.: US 10,982,459 B2
(45) Date of Patent: Apr. 20, 2021

(54) ROTATING A LONG VESSEL

(71) Applicants: Seyd Hossein Mousavi, Tehran (IR); Amin Jamalimehr, Isfahan (IR); Mohammadali Hosseinimehr, Isfahan (IR); Ali Abbasi Baharanchi, Isfahan (IR); Ashkan Torabi Goodarzi, Isfahan (IR); Saeed Hashemi, Tehran (IR); Farshad Fadakar Kourkah, Tehran (IR); Mohammad Durali, Tehran (IR)

(72) Inventors: Seyd Hossein Mousavi, Tehran (IR); Amin Jamalimehr, Isfahan (IR); Mohammadali Hosseinimehr, Isfahan (IR); Ali Abbasi Baharanchi, Isfahan (IR); Ashkan Torabi Goodarzi, Isfahan (IR); Saeed Hashemi, Tehran (IR); Farshad Fadakar Kourkah, Tehran (IR); Mohammad Durali, Tehran (IR)

( * ) Notice: Subject to any disclaimer, the term of this patent is extended or adjusted under 35 U.S.C. 154(b) by 0 days.

(21) Appl. No.: 16/512,465

(22) Filed: Jul. 16, 2019

(65) Prior Publication Data

US 2020/0002967 A1 Jan. 2, 2020

Related U.S. Application Data

(60) Provisional application No. 62/698,986, filed on Jul. 17, 2018.

(51) Int. Cl.
*E04H 12/34* (2006.01)
*E21B 19/15* (2006.01)

(52) U.S. Cl.
CPC ..... *E04H 12/345* (2013.01); *E21B 19/155* (2013.01)

(58) Field of Classification Search
CPC ..... E04H 12/345; E21B 19/155; B66C 1/42; B66F 11/00
See application file for complete search history.

(56) References Cited

U.S. PATENT DOCUMENTS

| | | | | |
|---|---|---|---|---|
| 3,795,323 A * | 3/1974 | Ouska | B21C 47/24 414/778 |
| 7,918,636 B1 * | 4/2011 | Orgeron | E21B 19/087 414/22.55 |
| 2019/0003271 A1 * | 1/2019 | Clarke | E21B 19/155 |

* cited by examiner

*Primary Examiner* — Lynn E Schwenning
(74) *Attorney, Agent, or Firm* — Bajwa IP Law Firm; Haris Zaheer Bajwa

(57) ABSTRACT

A system for rotating a vessel may include a container assembly, a linear actuating mechanism, and a double-pivot link. An exemplary container assembly may include a head end frame that may be spaced apart from and interconnected with a tail end frame. An exemplary container assembly may hold the vessel or a portion of the vessel. An exemplary linear actuating mechanism may be coupled to a bottom edge of the tail end frame and may drive a translational movement of the bottom edge of the tail end frame along a first axis. An exemplary double-pivot link may be pivotally connected between a top edge of the head end frame and a fixed revolute joint. An exemplary double-pivot link may rotate the top edge about the fixed revolute joint responsive to the translational movement of the bottom edge of the tail end frame along the first axis.

19 Claims, 21 Drawing Sheets

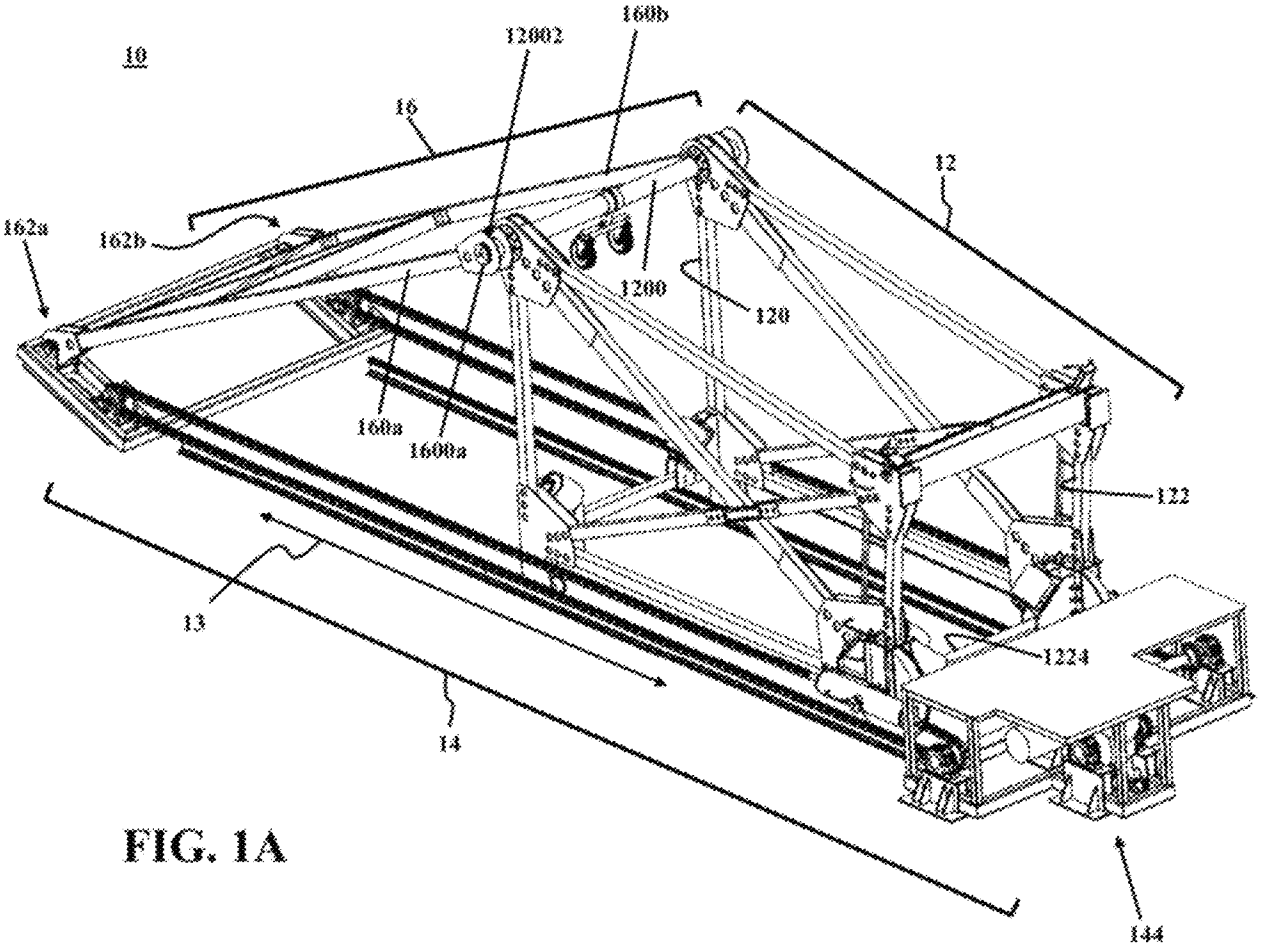
10
12
12a
12b
12b2
12b2a
12b2b
12b2c
12b2d
12b2e
12b2f
12b2g
12b2h
12b2i
12b2j
12b2k
12b2l
12b2m
12b2n
12b2o
12b2p
12b2q
12b2r
12b2s
12b2t
12b2u
12b2v
12b2w
12b2x
12b2y
12b2z
12b2aa
12b2ab
12b2ac
12b2ad
12b2ae
12b2af
12b2ag
12b2ah
12b2ai
12b2aj
12b2ak
12b2al
12b2am
12b2an
12b2ao
12b2ap
12b2aq
12b2ar
12b2as
12b2at
12b2au
12b2av
12b2aw
12b2ax
12b2ay
12b2az
12b2ba
12b2bb
12b2bc
12b2bd
12b2be
12b2bf
12b2bg
12b2bh
12b2bi
12b2bj
12b2bk
12b2bl
12b2bm
12b2bn
12b2bo
12b2bp
12b2bq
12b2br
12b2bs
12b2bt
12b2bu
12b2bv
12b2bw
12b2bx
12b2by
12b2bz
12b2ca
12b2cb
12b2cc
12b2cd
12b2ce
12b2cf
12b2cg
12b2ch
12b2ci
12b2cj
12b2ck
12b2cl
12b2cm
12b2cn
12b2co
12b2cp
12b2cq
12b2cr
12b2cs
12b2ct
12b2cu
12b2cv
12b2cw
12b2cx
12b2cy
12b2cz
12b2da
12b2db
12b2dc
12b2dd
12b2de
12b2df
12b2dg
12b2dh
12b2di
12b2dj
12b2dk
12b2dl
12b2dm
12b2dn
12b2do
12b2dp
12b2dq
12b2dr
12b2ds
12b2dt
12b2du
12b2dv
12b2dw
12b2dx
12b2dy
12b2dz
12b2ea
12b2eb
12b2ec
12b2ed
12b2ee
12b2ef
12b2eg
12b2eh
12b2ei
12b2ej
12b2ek
12b2el
12b2em
12b2en
12b2eo
12b2ep
12b2eq
12b2er
12b2es
12b2et
12b2eu
12b2ev
12b2ew
12b2ex
12b2ey
12b2ez
12b2fa
12b2fb
12b2fc
12b2fd
12b2fe
12b2ff
12b2fg
12b2fh
12b2fi
12b2fj
12b2fk
12b2fl
12b2fm
12b2fn
12b2fo
12b2fp
12b2fq
12b2fr
12b2fs
12b2ft
12b2fu
12b2fv
12b2fw
12b2fx
12b2fy
12b2fz
12b2ga
12b2gb
12b2gc
12b2gd
12b2ge
12b2gf
12b2gg
12b2gh
12b2gi
12b2gj
12b2gk
12b2gl
12b2gm
12b2gn
12b2go
12b2gp
12b2gq
12b2gr
12b2gs
12b2gt
12b2gu
12b2gv
12b2gw
12b2gx
12b2gy
12b2gz
12b2ha
12b2hb
12b2hc
12b2hd
12b2he
12b2hf
12b2hg
12b2hh
12b2hi
12b2hj
12b2hk
12b2hl
12b2hm
12b2hn
12b2ho
12b2hp
12b2hq
12b2hr
12b2hs
12b2ht
12b2hu
12b2hv
12b2hw
12b2hx
12b2hy
12b2hz
12b2ia
12b2ib
12b2ic
12b2id
12b2ie
12b2if
12b2ig
12b2ih
12b2ii
12b2ij
12b2ik
12b2il
12b2im
12b2in
12b2io
12b2ip
12b2iq
12b2ir
12b2is
12b2it
12b2iu
12b2iv
12b2iw
12b2ix
12b2iy
12b2iz
12b2ja
12b2jb
12b2jc
12b2jd
12b2je
12b2jf
12b2jg
12b2jh
12b2ji
12b2jj
12b2jk
12b2jl
12b2jm
12b2jn
12b2jo
12b2jp
12b2jq
12b2jr
12b2js
12b2jt
12b2ju
12b2jv
12b2jw
12b2jx
12b2jy
12b2jz
12b2ka
12b2kb
12b2kc
12b2kd
12b2ke
12b2kf
12b2kg
12b2kh
12b2ki
12b2kj
12b2kk
12b2kl
12b2km
12b2kn
12b2ko
12b2kp
12b2kq
12b2kr
12b2ks
12b2kt
12b2ku
12b2kv
12b2kw
12b2kx
12b2ky
12b2kz
12b2la
12b2lb
12b2lc
12b2ld
12b2le
12b2lf
12b2lg
12b2lh
12b2li
12b2lj
12b2lk
12b2ll
12b2lm
12b2ln
12b2lo
12b2lp
12b2lq
12b2lr
12b2ls
12b2lt
12b2lu
12b2lv
12b2lw
12b2lx
12b2ly
12b2lz
12b2ma
12b2mb
12b2mc
12b2md
12b2me
12b2mf
12b2mg
12b2mh
12b2mi
12b2mj
12b2mk
12b2ml
12b2mm
12b2mn
12b2mo
12b2mp
12b2mq
12b2mr
12b2ms
12b2mt
12b2mu
12b2mv
12b2mw
12b2mx
12b2my
12b2mz
12b2na
12b2nb
12b2nc
12b2nd
12b2ne
12b2nf
12b2ng
12b2nh
12b2ni
12b2nj
12b2nk
12b2nl
12b2nm
12b2nn
12b2no
12b2np
12b2nq
12b2nr
12b2ns
12b2nt
12b2nu
12b2nv
12b2nw
12b2nx
12b2ny
12b2nz
12b2oa
12b2ob
12b2oc
12b2od
12b2oe
12b2of
12b2og
12b2oh
12b2oi
12b2oj
12b2ok
12b2ol
12b2om
12b2on
12b2oo
12b2op
12b2oq
12b2or
12b2os
12b2ot
12b2ou
12b2ov
12b2ow
12b2ox
12b2oy
12b2oz
12b2pa
12b2pb
12b2pc
12b2pd
12b2pe
12b2pf
12b2pg
12b2ph
12b2pi
12b2pj
12b2pk
12b2pl
12b2pm
12b2pn
12b2po
12b2pp
12b2pq
12b2pr
12b2ps
12b2pt
12b2pu
12b2pv
12b2pw
12b2px
12b2py
12b2pz
12b2qa
12b2qb
12b2qc
12b2qd
12b2qe
12b2qf
12b2qg
12b2qh
12b2qi
12b2qj
12b2qk
12b2ql
12b2qm
12b2qn
12b2qo
12b2qp
12b2qq
12b2qr
12b2qs
12b2qt
12b2qu
12b2qv
12b2qw
12b2qx
12b2qy
12b2qz
12b2ra
12b2rb
12b2rc
12b2rd
12b2re
12b2rf
12b2rg
12b2rh
12b2ri
12b2rj
12b2rk
12b2rl
12b2rm
12b2rn
12b2ro
12b2rp
12b2rq
12b2rr
12b2rs
12b2rt
12b2ru
12b2rv
12b2rw
12b2rx
12b2ry
12b2rz
12b2sa
12b2sb
12b2sc
12b2sd
12b2se
12b2sf
12b2sg
12b2sh
12b2si
12b2sj
12b2sk
12b2sl
12b2sm
12b2sn
12b2so
12b2sp
12b2sq
12b2sr
12b2ss
12b2st
12b2su
12b2sv
12b2sw
12b2sx
12b2sy
12b2sz
12b2ta
12b2tb
12b2tc
12b2td
12b2te
12b2tf
12b2tg
12b2th
12b2ti
12b2tj
12b2tk
12b2tl
12b2tm
12b2tn
12b2to
12b2tp
12b2tq
12b2tr
12b2ts
12b2tt
12b2tu
12b2tv
12b2tw
12b2tx
12b2ty
12b2tz
12b2ua
12b2ub
12b2uc
12b2ud
12b2ue
12b2uf
12b2ug
12b2uh
12b2ui
12b2uj
12b2uk
12b2ul
12b2um
12b2un
12b2uo
12b2up
12b2uq
12b2ur
12b2us
12b2ut
12b2uu
12b2uv
12b2uw
12b2ux
12b2uy
12b2uz
12b2va
12b2vb
12b2vc
12b2vd
12b2ve
12b2vf
12b2vg
12b2vh
12b2vi
12b2vj
12b2vk
12b2vl
12b2vm
12b2vn
12b2vo
12b2vp
12b2vq
12b2vr
12b2vs
12b2vt
12b2vu
12b2vv
12b2vw
12b2vx
12b2vy
12b2vz
12b2wa
12b2wb
12b2wc
12b2wd
12b2we
12b2wf
12b2wg
12b2wh
12b2wi
12b2wj
12b2wk
12b2wl
12b2wm
12b2wn
12b2wo
12b2wp
12b2wq
12b2wr
12b2ws
12b2wt
12b2wu
12b2wv
12b2ww
12b2wx
12b2wy
12b2wz
12b2xa
12b2xb
12b2xc
12b2xd
12b2xe
12b2xf
12b2xg
12b2xh
12b2xi
12b2xj
12b2xk
12b2xl
12b2xm
12b2xn
12b2xo
12b2xp
12b2xq
12b2xr
12b2xs
12b2xt
12b2xu
12b2xv
12b2xw
12b2xx
12b2xy
12b2xz
12b2ya
12b2yb
12b2yc
12b2yd
12b2ye
12b2yf
12b2yg
12b2yh
12b2yi
12b2yj
12b2yk
12b2yl
12b2ym
12b2yn
12b2yo
12b2yp
12b2yq
12b2yr
12b2ys
12b2yt
12b2yu
12b2yv
12b2yw
12b2yx
12b2yy
12b2yz
12b2za
12b2zb
12b2zc
12b2zd
12b2ze
12b2zf
12b2zg
12b2zh
12b2zi
12b2zj
12b2zk
12b2zl
12b2zm
12b2zn
12b2zo
12b2zp
12b2zq
12b2zr
12b2zs
12b2zt
12b2zu
12b2zv
12b2zw
12b2zx
12b2zy
12b2zz
12b3a
12b3b
12b3c
12b3d
12b3e
12b3f
12b3g
12b3h
12b3i
12b3j
12b3k
12b3l
12b3m
12b3n
12b3o
12b3p
12b3q
12b3r
12b3s
12b3t
12b3u
12b3v
12b3w
12b3x
12b3y
12b3z
12b4a
12b4b
12b4c
12b4d
12b4e
12b4f
12b4g
12b4h
12b4i
12b4j
12b4k
12b4l
12b4m
12b4n
12b4o
12b4p
12b4q
12b4r
12b4s
12b4t
12b4u
12b4v
12b4w
12b4x
12b4y
12b4z
12b5a
12b5b
12b5c
12b5d
12b5e
12b5f
12b5g
12b5h
12b5i
12b5j
12b5k
12b5l
12b5m
12b5n
12b5o
12b5p
12b5q
12b5r
12b5s
12b5t
12b5u
12b5v
12b5w
12b5x
12b5y
12b5z

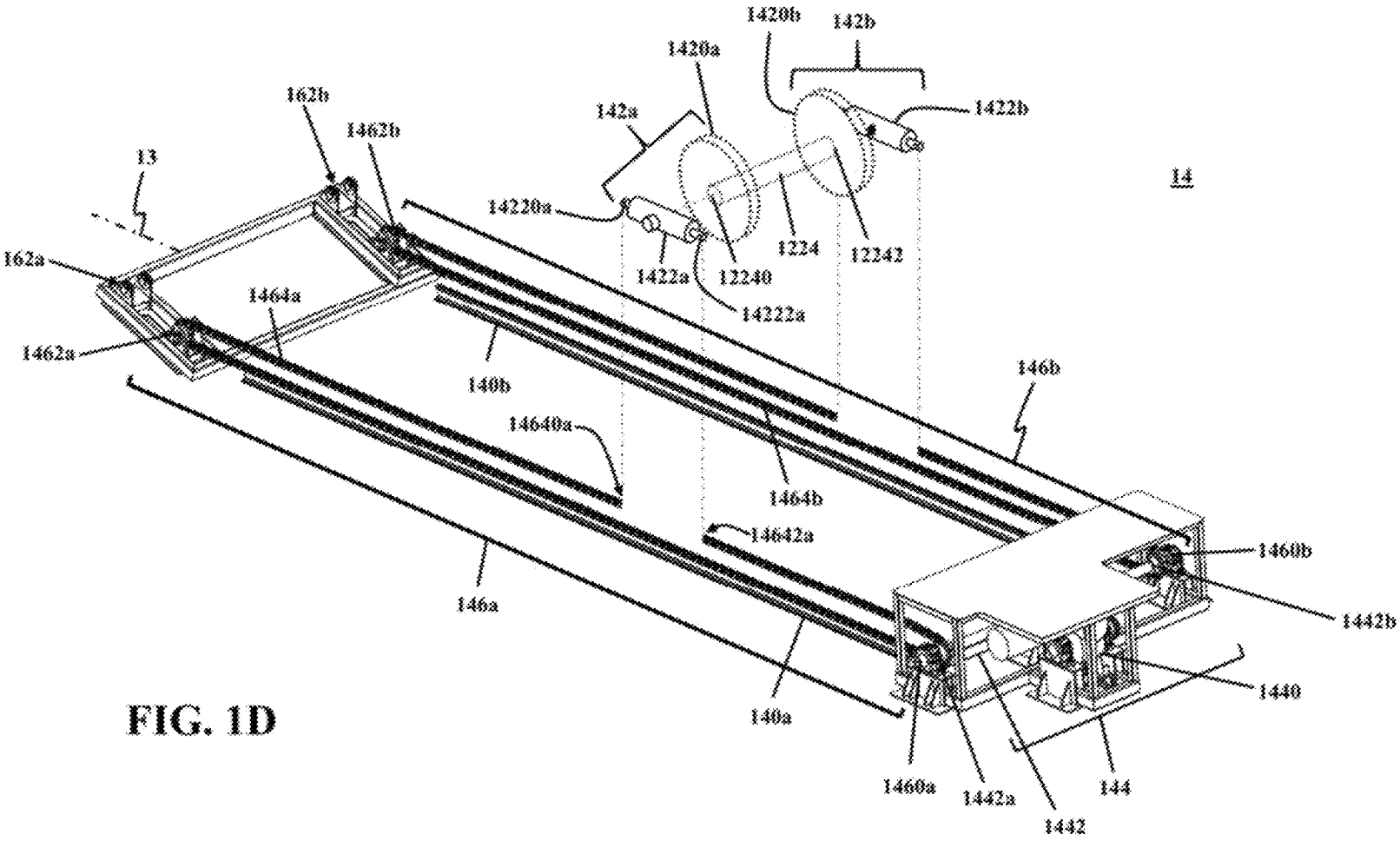
14
1422b
1460b
1440
144
1442
1442a
1460a
146b
1422b
1424a
1424b
1422a
1424a
1424b
1422a
1424a
1424b
1422a

ROTATING A LONG VESSEL

CROSS-REFERENCE TO RELATED APPLICATION

This application claims the benefit of priority from U.S. Provisional Patent Application Ser. No. 62/698,986, filed on Jul. 17, 2018, and entitled "LARGE-DIAMETER PIPE TURNOVER MACHINE," which is incorporated herein by reference in its entirety.

TECHNICAL FIELD

The present disclosure relates to systems and methods for rotating long objects such as vessels and pipe sections, and particularly relates to systems and methods for rotating heavy-lift objects into an upright position.

BACKGROUND

Long and large-diameter objects such as pipes, process vessels, and reactors are frequently used in industrial projects, including in oil and gas industries and hydropower plants. Manufacturing and installing such long, large-diameter, and generally heavy-lift objects involves lengthy and complex processes. Different strategies are utilized in industrial projects to simplify manufacturing and installation of the aforementioned objects, such as modularization, prefabrication, preassembly, and off-site fabrication, where portions of manufacturing process may be relocated to off-site manufacturing workshops.

However, this off-site prefabrication and on-site installation may lead to much more frequent use of transportation and lifting machinery, such as cranes. A common practice for lifting long heavy objects is utilizing two mobile cranes with each mobile crane hooked to one end of the object. The lifting process starts with an object in a horizontal position and then as one mobile crane raises a top end of the object, the other mobile crane holds a bottom end of the object close to the ground until the object is completely rotated into the vertical position.

However, this two-crane lifting method requires proper coordination between the two cranes to avoid side loadings from an out-of-plumb load line when one crane swings and pulls the other crane with it or to avoid jerking or bouncing of the object when the speeds of the two cranes are different. Moreover, other problems such as swinging movements of an object and booms tip collision may have a significant negative impact on the overall scheduling, cost, and safety of utilizing a two-crane lifting method. A significant issue with utilizing a two-crane method or approach is that the proper coordination between the two cranes depends heavily on skills of human operators and therefore has a significant impact due to human errors, which may be reduced but are not entirely unavoidable.

There is, therefore, a need for a system and method that may allow for rotating a long, large-diameter, and heavy object from a horizontal position into a vertical position without a need for utilizing multiple cranes. There is further a need for simple, cost-effective, accurate, and safe systems and methods for rotating long and large objects, in which human involvement may be minimized. There is further a need for systems and methods for rotating long and large objects to a vertical position in applications where there is not enough room for utilizing mobile cranes, for example, for installing large pipes in vertically dug wells in underground tunnels.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments, the present disclosure is directed to a system for rotating a vessel that may include a container assembly. An exemplary system for rotating a vessel may include a container assembly that may have a head end frame and a tail end frame. The exemplary head end frame and the exemplary tail end frame may be interconnected utilizing a plurality of side frame members. An exemplary container assembly may be configured to hold the vessel or a portion of the vessel. An exemplary system for rotating a vessel may further include a linear actuating mechanism that may be coupled to a bottom edge of the tail end frame. An exemplary linear actuating mechanism may be configured to drive a translational movement of the bottom edge of the tail end frame along a first axis. The first axis may be perpendicular to a main axis of the bottom edge. An exemplary system for rotating a vessel may further include a double-pivot link that may be pivotally connected between a top edge of the head end frame and a fixed revolute joint. An exemplary double-pivot link may be configured to rotate the top edge about the fixed revolute joint responsive to the translational movement of the bottom edge of the tail end frame along the first axis.

In an exemplary embodiment, the head end frame may include a header beam, a bottom end beam disposed below and parallel with the header beam, and a pair of head corner posts interconnecting corresponding ends of the header beam and the bottom end beam. An exemplary double-pivot link may be pivotally connected to either end of the header beam.

In an exemplary embodiment, the double-pivot link may include a pair of parallel links, where a first end of each link of the pair of parallel links may be pivotally connected at a corresponding end of the header beam.

In an exemplary embodiment, the tail end frame may include a top end removable rail, a tail sill disposed below and parallel with the top end removable rail, and a pair of tail corner posts interconnecting corresponding ends of the top end removable rail and the tail sill. An exemplary linear actuating mechanism may be coupled to either end of the tail sill.

In an exemplary embodiment, an exemplary linear actuating mechanism may include at least two parallel horizontal guides disposed at either side of the container assembly, where the at least two horizontal guides extending along the first axis, and at least two guide couplers, where each guide coupler may be coupled to a respective horizontal guide. Each exemplary guide coupler may be configured to move along the respective horizontal guide along the first axis. Each guide coupler of the at least two guide couplers may further be pivotally coupled to a respective end of the tail sill.

In an exemplary embodiment, an exemplary linear actuating mechanism may further include a power generator that may be configured to generate a drive power for moving the at least two guide couplers along the first axis, and a power transmission that may be connected between the power generator and the at least two guide couplers. An exemplary power transmission may be configured to transmit the drive power to the at least two guide couplers.

In an exemplary embodiment, an exemplary power transmission may include at least two rotating members that may be disposed at first ends of the at least two horizontal guides, where the rotating members may be coupled to the power generator. An exemplary rotating member may be associated with a respective horizontal guide and the at least two rotating members may be configured to be rotated by the power generator, an exemplary power transmission may further include at least two idler rotating members disposed at second opposing ends of the at least two horizontal guides, each idler rotating member of the at least two idler rotating members disposed in line with a corresponding rotating member of the at least two rotating members along the first axis, and at least two linear members, each linear member of the at least two linear members connected between a respective rotating member of the at least two rotating members and a corresponding idler rotating member of the at least two idler rotating members, each linear member of the at least two linear members further coupled to a respective guide coupler of the at least two guide couplers, each linear member of the at least two linear members configured to transmit and convert a rotational movement of a respective rotating member to a translational movement of a respective guide coupler horizontally along the first axis.

In an exemplary embodiment, a plurality of side frame members may include a pair of parallel top side beams interconnecting corresponding ends of the header beam and the top end removable rail, and a pair of parallel bottom side beams interconnecting corresponding ends of the bottom end beam and the tail sill.

In an exemplary embodiment, an exemplary linear actuating mechanism may include at least two parallel horizontal guides disposed at either sides of the container assembly, the at least two horizontal guides extending along the first axis, and at least two guide couplers, each guide coupler of the at least two guide couplers coupled to a respective horizontal guide of the at least two horizontal guides, each guide coupler configured to move along the respective horizontal guide along the first axis. Each guide coupler of the at least two guide couplers may further be pivotally coupled to a respective end of the bottom edge of the tail end frame.

In an exemplary embodiment, the linear actuating mechanism may further include a power generator that may be configured to generate a drive power for moving the at least two guide couplers along the first axis, and a power transmission that may be connected between the power generator and the at least two guide couplers. An exemplary power transmission may be configured to transmit the drive power to the at least two guide couplers.

In an exemplary embodiment, an exemplary power transmission may include at least two rotating members disposed at first ends of the at least two horizontal guides, the at least two rotating members coupled to the power generator, each rotating member of the at least two rotating members associated with a respective horizontal guide of the at least two horizontal guides, the at least two rotating members configured to be rotated by the power generator, at least two idler rotating members disposed at second opposing ends of the at least two horizontal guides, each idler rotating member of the at least two idler rotating members disposed in line with a corresponding rotating member of the at least two rotating members along the first axis, and at least two linear members, each linear member of the at least two linear members connected between a respective rotating member of the at least two rotating members and a corresponding idler rotating member of the at least two idler rotating members, each linear member of the at least two linear members further coupled to a respective guide coupler of the at least two guide couplers, each linear member of the at least two linear members configured to transmit and convert a rotational movement of a respective rotating member to a translational movement of a respective guide coupler horizontally along the first axis.

In an exemplary embodiment, an exemplary power generator may include a motor coupled to a main shaft. An exemplary motor may be configured to drive a rotational movement of the main shaft.

In an exemplary embodiment, the at least two rotating members may include at least two sprockets coupled to either end of the main shaft. The at least two idler rotating members may include at least two idler sprockets. The at least two linear members may include at least two chains, each chain of the at least two chains extended in a loop around a respective sprocket of the least two sprockets and a corresponding idler sprocket of the at least two idler sprockets.

In an exemplary embodiment, the power transmission may further include at least two coupling mechanisms, where each coupling mechanism of the at least two coupling mechanisms may be configured to couple a linear member of the at least two linear members to a respective guide coupler of the at least two guide couplers. An exemplary coupling mechanism may include a first spring-loaded shaft movably disposed within a cylinder, a first end of the first spring-loaded shaft extending out of a first side of the cylinder, the first end of the first spring-loaded shaft coupled to a first end of the linear member, and a second spring-loaded shaft movably disposed within a cylinder, a first end of the second spring-loaded shaft extending out of a second opposing end of the cylinder, the first end of the second spring-loaded shaft coupled to a second end of the linear member.

In an exemplary embodiment, the at least two rotating members may include at least two pulleys coupled to either end of the main shaft. The at least two idler rotating members may include at least two dummy pulleys. The at least two linear members may include at least two belts, each belt of the at least two belts extended in a loop around a respective pulley of the least two pulleys and a corresponding dummy pulley of the at least two dummy pulleys.

In an exemplary embodiment, the at least two rotating members may include at least two winding rollers that may be coupled to either end of the main shaft. The at least two idler rotating members may include at least two idler rollers. The at least two linear members may include at least two ropes, each rope of the at least two ropes extended in a loop around a respective winding roller of the least two winding rollers and a corresponding idler roller of the at least two idler rollers.

In an exemplary embodiment, the revolute joint may include a pair of pin joints and the opposing second end of each link of the pair of parallel links pivotally coupled with a respective pin joint of the pair of pin joints.

According to one or more exemplary embodiments, the present disclosure is directed to a method for rotating a vessel. An exemplary method may include placing the vessel or a portion of the vessel within a container assembly, the container assembly comprising a head end frame and a tail end frame, the head end frame and the tail end frame interconnected utilizing a plurality of side frame members, restraining translational and rotational movements of the vessel relative to the container assembly, actuating a linear movement of a bottom edge of the tail end frame along a first axis, the first axis perpendicular to a main axis of the bottom edge, and rotating a top edge of the head end frame about the main axis of the bottom edge responsive to the linear movement of the bottom edge of the tail end frame along the first axis.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 1A illustrates a perspective view of a system for rotating a vessel, consistent with one or more exemplary embodiments of the present disclosure;

FIG. 1D illustrates a perspective view of a linear actuating mechanism, consistent with one or more exemplary embodiments of the present disclosure;

DETAILED DESCRIPTION

In the following detailed description, numerous specific details are set forth by way of examples to provide a thorough understanding of the relevant teachings related to the exemplary embodiments. However, it should be apparent that the present teachings may be practiced without such details. In other instances, well-known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be plain to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

The present disclosure is directed to systems and methods for rotating long vessels, such as process vessels, reactors, large-diameter pipes, etc. Exemplary methods may include encompassing a vessel within a container assembly such that translational and rotational movements of the vessel may be restrained relative to the container assembly and then rotating the container assembly utilizing an actuating mechanism. In an exemplary system for rotating long vessels, a container assembly including a head end frame spaced apart and interconnected with a tail end frame may be utilized for encompassing a vessel or a portion of a vessel. An exemplary container assembly may be coupled to an actuating mechanism that may be configured to rotate the exemplary container assembly about a bottom edge of a tail end frame of the exemplary container assembly. An exemplary actuating mechanism may include a linear actuator that may be coupled to a bottom edge of a tail end frame of an exemplary container assembly configured to move the bottom edge along a translational axis. An exemplary actuating mechanism may further include a double pivot link that may be coupled between a top edge of a head end frame of the container assembly and a revolute joint, where the double pivot link may rotate the top edge about the revolute joint in response to a translational movement of the bottom edge along the translational axis.

Figure 1B:
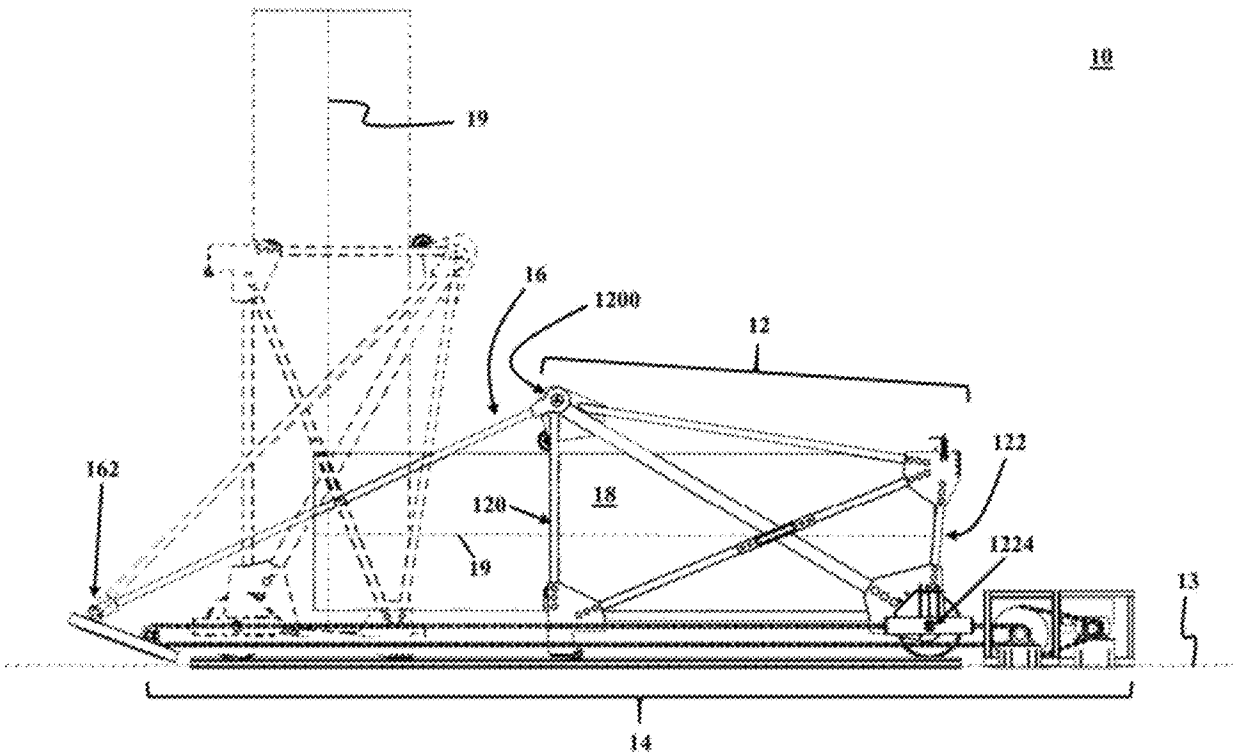
FIG. 1B illustrates a side view of a system for rotating a vessel, consistent with one or more exemplary embodiments of the present disclosure.

FIG. 1A illustrates a perspective view of system 10 for rotating a vessel, consistent with one or more exemplary embodiments of the present disclosure. FIG. 1B illustrates a side-view of system 10 for rotating vessel 18, consistent with one or more exemplary embodiments of the present disclosure.

In an exemplary embodiment, system 10 may include a container assembly 12 that may be configured to encompass and hold vessel 18 or a portion of vessel 18, a linear actuating mechanism 14 that may be coupled to container assembly 12 from a first end of container assembly 12, and a double-pivot link 16 that may be pivotally connected to a second opposing end of container assembly 12. In an exemplary embodiment, container assembly 12 may include a head end frame 120 that may be interconnected with and spaced apart from a tail end frame 122. In an exemplary embodiment, linear actuating mechanism 14 may be coupled to a tail sill 1224 of tail end frame 122 and may be configured to drive a translational movement of tail sill 1224 of tail end frame 122 along a first axis 13 perpendicular to a longitudinal axis 12240 of tail sill 1224. In an exemplary embodiment, double-pivot link 16 may be pivotally connected between a header beam 1200 of head end frame 120 and a fixed revolute joint 162. Double-pivot link 16 may be configured to cause a rotational movement of header beam 1200 of head end frame 120 about fixed revolute joint 162 in response to a translational movement of tail sill 1224 of tail end frame 122 along first axis 13. In an exemplary embodiment, fixed revolute joint 162 may be mounted on a plane parallel with a horizontal plane of first axis 13. In an exemplary embodiment, double-pivot link 16 may support container assembly 12 when container assembly 12 is being rotated, such that container assembly 12 may be gradually rotated toward a vertical alignment (For example, as shown by broken lines in FIG. 1B) as linear actuating mechanism 14 drives a translational movement of tail sill 1224 of tail end frame 122 along first axis 13.

In an exemplary embodiments, such configuration of linear actuating mechanism 14 and double-pivot link 16 may allow for actuating a rotational movement of container assembly 12 from a horizontal position (shown by solid lines in FIG. 1B) where surface normals of head end frame 120 and tail end frame 122 may be substantially parallel with first axis 13 to a desirable position between the horizontal position and a vertical position (shown by broken lines in FIG. 1B) where surface normals of head end frame 120 and tail end frame 122 may be substantially perpendicular to first axis 13. In an exemplary embodiment, vessel 18 or a portion of vessel 18 may be placed and secured within container assembly 12 such that rotational and translational movements of vessel 18 relative to container assembly 12 may be restrained. In exemplary embodiments, restraining translational and rotational movements of vessel 18 relative to container assembly 12 may allow for rotating vessel 18 by rotating container assembly 12 without any unwanted movements of vessel 18 relative to container assembly 12. In an exemplary embodiment, vessel 18 may be any elongated vessel, such as a pipe section or an elongated pressure vessel. In an exemplary embodiment, vessel 18 may have one of a circular, rectangular, or square cross-sections.

Figure 7A:
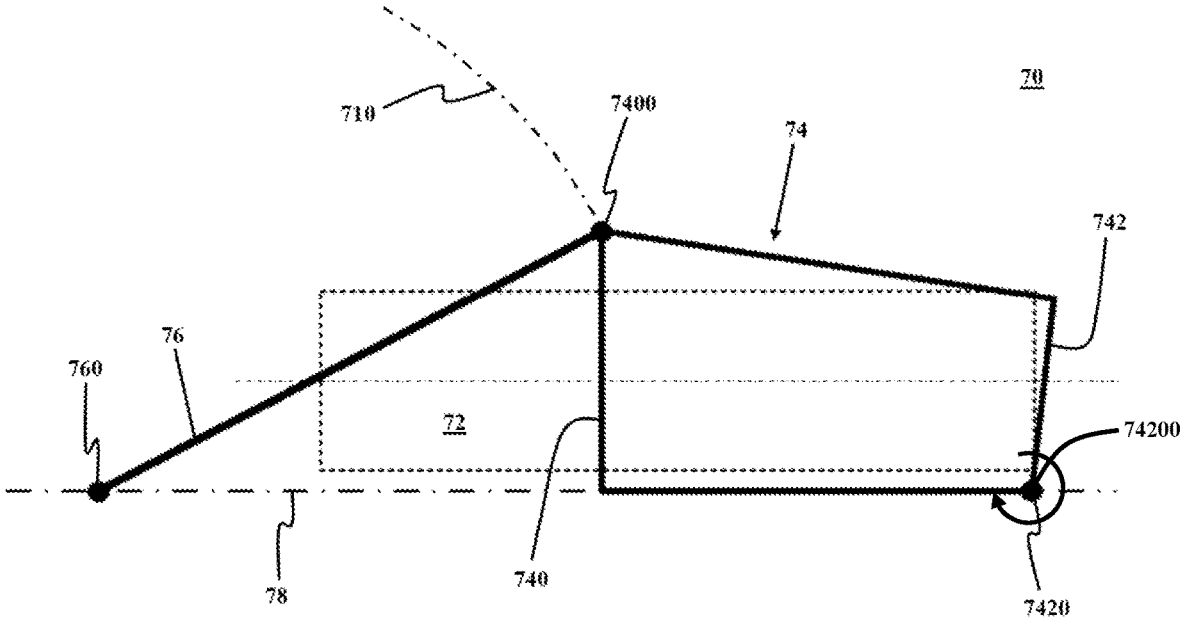
FIGS. 7A-7C illustrate schematic side-views of a system for rotating a vessel, consistent with one or more exemplary embodiments of the present disclosure.
Figure 7B:
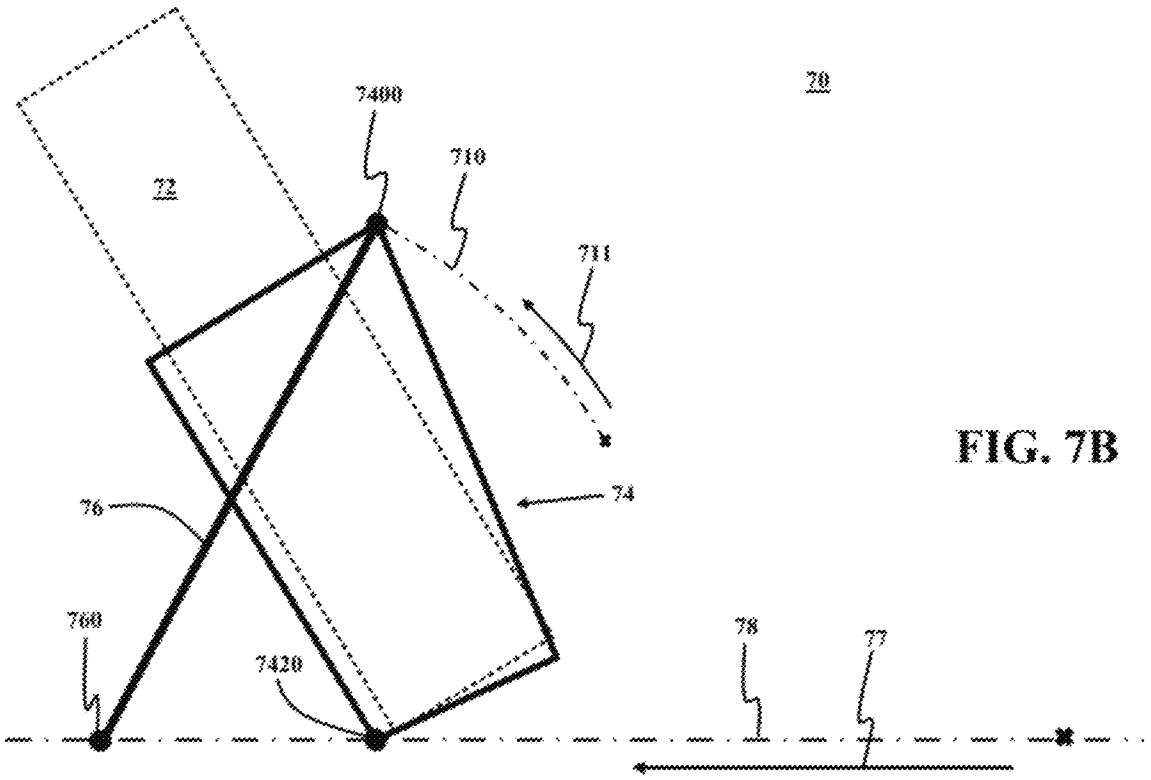
Figure 7C:
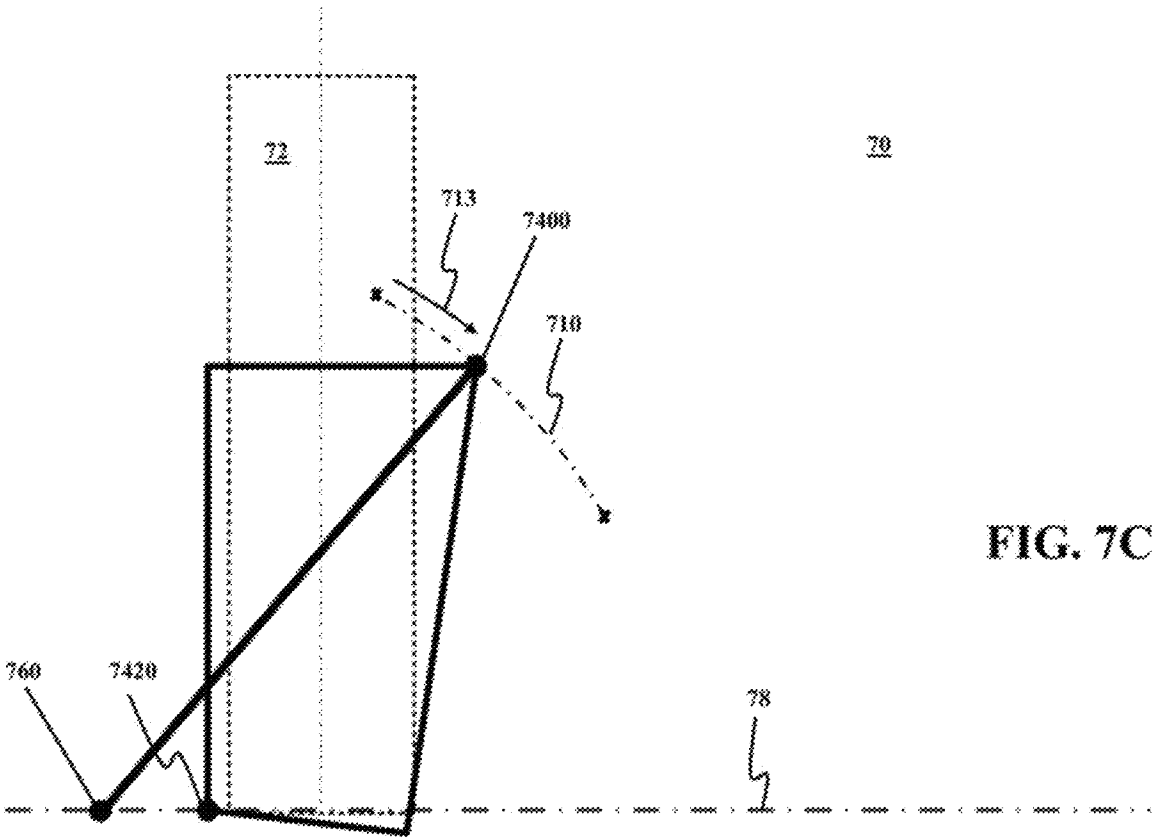

FIGS. 7A-7C illustrate schematic side-views of a system 70 for rotating vessel 72, consistent with one or more exemplary embodiments of the present disclosure. In an exemplary embodiment, system 70 may be similar to system 10 and may include a container assembly 74 similar to container assembly 12. In an exemplary embodiment, container assembly 74 may include a head end frame 740 similar to head end frame 120 and a tail end frame 742 similar to tail end frame 122. In an exemplary embodiment, container assembly 74 may be configured to encompass and hold vessel 72 or a portion of vessel 72 between head end frame 740 and tail end frame 742. In an exemplary embodiment, vessel 72 may be similar to vessel 18. In an exemplary embodiment, vessel 72 may be any elongated vessel, such as a pipe section or an elongated pressure vessel. In an exemplary embodiment, vessel 72 may have one of a circular, rectangular, or square cross-sections.

In an exemplary embodiment, system 70 may further include a double-pivot link 76 similar to double-pivot link 16 that may be connected between a top edge 7400 of head end frame 740 and a revolute joint 760 similar to revolute joint 162. In an exemplary embodiment, revolute joint 760 may be mounted in line with a bottom edge 7420 of tail end frame 742. In an exemplary embodiment, top edge 7400 may be similar to header beam 1200, and bottom edge 7420 may be similar to tail sill 1224.

In an exemplary embodiment, system 70 may be utilized for rotating vessel 72 from a horizontal position as shown in FIG. 7A to a desired position between the horizontal position and a vertical position as shown in FIG. 7C. To this end, in an exemplary embodiment, bottom edge 7420 may be linearly moved toward revolute joint 760 along a horizontal translational axis 78 in a direction shown by arrow 77. In response to linear movement of bottom edge 7420 along horizontal translational axis 78, double-pivot link 76 may cause top edge 7400 to rotate about revolute joint 760 along a trajectory 710 which in turn may lead to a rotational movement of container assembly 74 about a longitudinal axis 74200 of bottom edge 7420 (longitudinal axis 74200 is perpendicular to the view in FIGS. 7A-7C). In an exemplary embodiment, linear movement of bottom edge 7420 may be actuated by a linear actuating mechanism such as linear actuating mechanism 14. In an exemplary embodiment, vessel 72 or a portion of vessel 72 may be secured within container assembly 74 such that translational and rotational movements of vessel 72 may be restrained relative to container assembly 74, this way, vessel 72 may be rotated along with container assembly 74 without any unwanted movements relative to container assembly 74.

In an exemplary embodiment, trajectory 710 may include a portion of a circular trajectory about revolute joint 760 with a radius equal to a length of double pivot link 76. In an exemplary embodiment, when bottom edge 7420 linearly moves toward revolute joint 760 along horizontal translational axis 78 in a direction shown by arrow 77, double pivot joint 76 may guide or otherwise force top edge 7400 to follow trajectory 710 in an upward movement in a direction shown by arrow 711. As bottom edge 7420 continues its linear movement toward revolute joint 760, and bottom edge 7420 passes bellow top edge 7400, double pivot joint 76 may guide top edge 7400 downward along trajectory 710 in a direction shown by arrow 713 to a point where vessel 72 may be erected into a vertical position, for example, as shown in FIG. 7C.

Figure 1C:
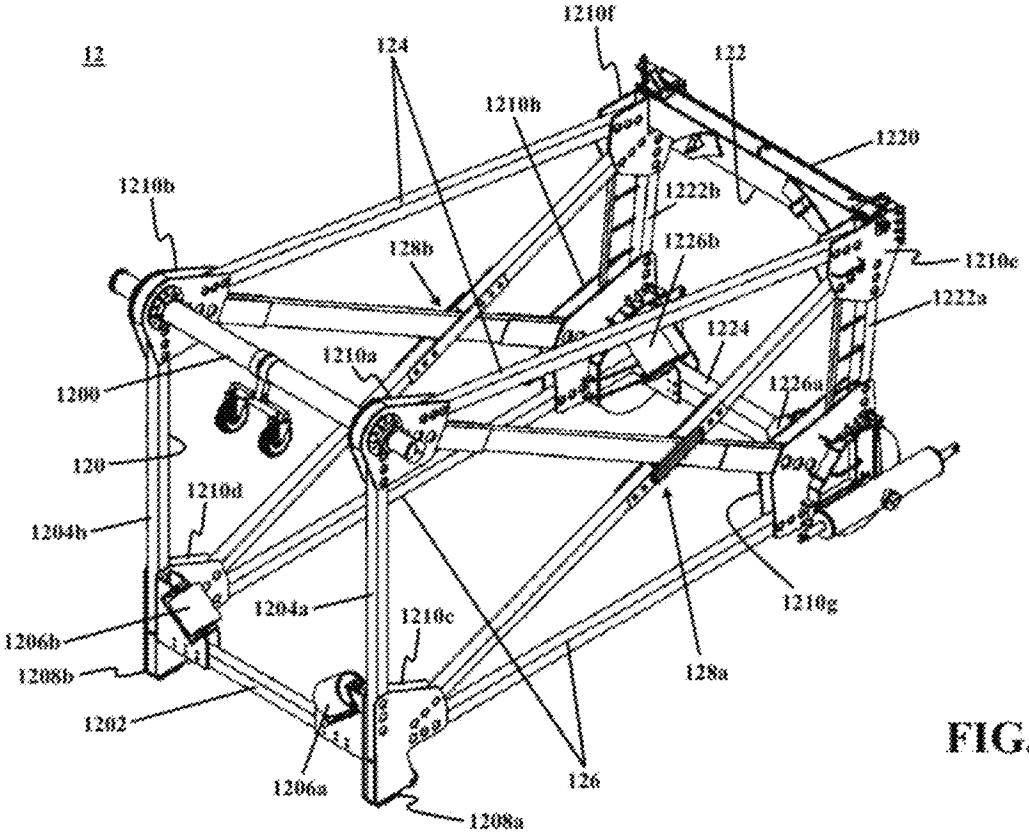
FIG. 1C illustrates a perspective view of a container assembly, consistent with one or more exemplary embodiments of the present disclosure.

FIG. 1C illustrates a perspective view of container assembly 12, consistent with one or more exemplary embodiments of the present disclosure. In an exemplary embodiment, head end frame 120 may include header beam 1200, a bottom end beam 1202 that may be disposed below and parallel with header beam 1200, and a pair of head corner posts (1204*a* and 1204*b*) that may interconnect corresponding ends of header beam 1200 and bottom end beam 1202. In an exemplary embodiment, double-pivot link 16 may include a pair of parallel links (160*a* and 160*b*), where respective first ends of each link of pair of parallel links (160*a* and 160*b*) may be pivotally connected at a respective corresponding end of header beam 1200. For example, a first end 1600*a* of link 160*a* may be pivotally coupled at a corresponding end 12002 of header beam 1200.

FIG. 1D illustrates a perspective view of linear actuating mechanism 14, consistent with one or more exemplary embodiments of the present disclosure. In an exemplary embodiment, linear actuating mechanism 14 may include at least two parallel horizontal guides (140*a* and 140*b*) that may be disposed at either side of container assembly 12, where horizontal guides (140*a* and 140*b*) may extend along first axis 13. In an exemplary embodiment, linear actuating mechanism 14 may further include at least two guide couplers (142*a* and 142*b*), where each guide coupler of guide couplers (142*a* and 142*b*) may be coupled to a respective horizontal guide of horizontal guides (140*a* and 140*b*). For example, guide coupler 142*a* may be coupled to horizontal guide 140*a* and guide coupler 142*b* may be coupled to horizontal guide 140*b*. As used herein, coupling guide couplers (142*a* and 142*b*) and respective horizontal guides (140*a* and 140*b*) may refer to engaging guide couplers (142*a* and 142*b*) with respective horizontal guides (140*a* and 140*b*). For example, guide couplers (142*a* and 142*b*) may be a pair of wheels that may be movably placed on horizontal guides (140*a* and 140*b*) that may be a pair of parallel tracks guiding the movement of the pair of wheels in a linear path along first axis 13. For example, guide couplers (142*a* and 142*b*) may be a pair of sliders that may be slidably placed within horizontal guides (140*a* and 140*b*) that may be a pair of sliding tracks guiding the movement of the pair of sliders in a linear path along first axis 13.

In an exemplary embodiment, guide couplers (142*a* and 142*b*) may include wheels (1420*a* and 1420*b*) such as railway wheels and horizontal guides (140*a* and 140*b*) may include tracks such as railroad tracks. In an exemplary embodiment, each guide coupler, for example, guide coupler 142*a* may be configured to move along a respective horizontal guide, for example, horizontal guide 140*a* along first axis 13.

In an exemplary embodiment, tail end frame 122 may include a top end removable rail 1220, tail sill 1224 that may be disposed below and parallel with top end removable rail 1220, and a pair of tail corner posts (1222*a* and 1222*b*) that may interconnect corresponding ends of top end removable rail 1220 and tail sill 1224. In an exemplary embodiment, tail end frame 122 may be interconnected and spaced apart from head end frame 120 by top side beams 124, and bottom side beams 126. In an exemplary embodiment, container assembly 12 may further include side cross bracings (128*a* and 128*b*) to reinforce the structure of container assembly 12.

In an exemplary embodiment, each guide coupler of guide couplers (142*a* and 142*b*) may further be pivotally coupled to a respective end of tail sill 1224 of tail end frame 122. For example, guide coupler 142*a* may further be pivotally coupled to respective end 12240 of tail sill 1224 and guide coupler 142*b* may further be pivotally coupled to respective end 12242 of tail sill 1224.

In an exemplary embodiment, linear actuating mechanism 14 may further include a power generator 144 that may be configured to generate a drive power for moving guide couplers (142*a* and 142*b*) along first axis 13, and a power transmission mechanism that may be connected between power generator 144 and guide couplers (142*a* and 142*b*) to transmit the drive power from power generator 144 to guide couplers (142*a* and 142*b*).

In an exemplary embodiment, the power transmission mechanism may include at least two rotating members (a rotating member 1460*a* and an idler rotating member 1460*b*) that may be disposed at first ends of horizontal guides (140*a* and 140*b*). In an exemplary embodiment, rotating member 1460*a* may be associated with horizontal guide 140*a* and idler rotating member 1460*b* may be associated with horizontal guide 140*b*. As used herein, in an exemplary embodiment, associating rotating member 1460*a* with horizontal guide 140*a* may refer to mounting rotating member 1460*a* in line with horizontal guide 140*a*. Similarly, associating idler rotating member 1460*b* with horizontal guide 140*b* may refer to mounting idler rotating member 1460*b* in line with horizontal guide 140*b*. In an exemplary embodiment, rotating member 1460*a* and idler rotating member 1460*b* may be coupled to power generator 144, where power generator 144 may be configured to drive a rotational movement of rotating member 1460*a* and idler rotating member 1460*b*.

In an exemplary embodiment, the power transmission mechanism may further include at least two idler rotating members (a first idler rotating member 1462*a* and a second idler rotating member 1462*b*) that may be disposed at second opposing ends of horizontal guides (140*a* and 140*b*). In an exemplary embodiment, each idler rotating member of idler rotating members (1462*a* and 1462*b*) may be disposed in line with a corresponding rotating member of rotating members (1460*a* and 1460*b*) along first axis 13. For example, first idler rotating member 1462*a* may be disposed in line with rotating member 1460*a* along first axis 13 and second idler rotating member 1462*b* may be disposed in line with idler rotating member 1460*b* along first axis 13.

In an exemplary embodiment, the power transmission mechanism may further include at least two linear members (a first linear member 1464*a* and a second linear member 1464*b*). In an exemplary embodiment, first linear member 1464*a* may be connected between first rotating member 1460*a* and corresponding first idler rotating member 1462*a* and second linear member 1464*b* may be connected between second rotating member 1460*b* and corresponding second idler rotating member 1462*b*. In an exemplary embodiment, first linear member 1464*a* may further be coupled to first guide coupler 142*a* and second linear member 1464*b* may further be coupled to second guide coupler 142*b*.

In an exemplary embodiment, first linear member 1464*a* may be configured to transmit and convert a rotational movement of rotating member 1460*a* to a translational movement of first guide coupler 142*a* horizontally along first axis 13. In an exemplary embodiment, second linear member 1464*b* may be configured to transmit and convert a rotational movement of second rotating member 1460*b* to a translational movement of second guide coupler 142*b* horizontally along first axis 13.

In an exemplary embodiment, each guide coupler of guide couplers (142*a* and 142*b*) may further include a respective coupling mechanism. For example, first guide coupler 142*a* may further include a first coupling mechanism 1422*a* and second guide coupler 142*b* may further include a second coupling mechanism 1422*b*. In an exemplary embodiment, first coupling mechanism 1422*a* may be configured to couple first linear member 1464*a* and wheel 1420*a* and second coupling mechanism 1422*b* may be configured to couple second linear member 1464*b* and wheel 1420*b*.

Figure 6:
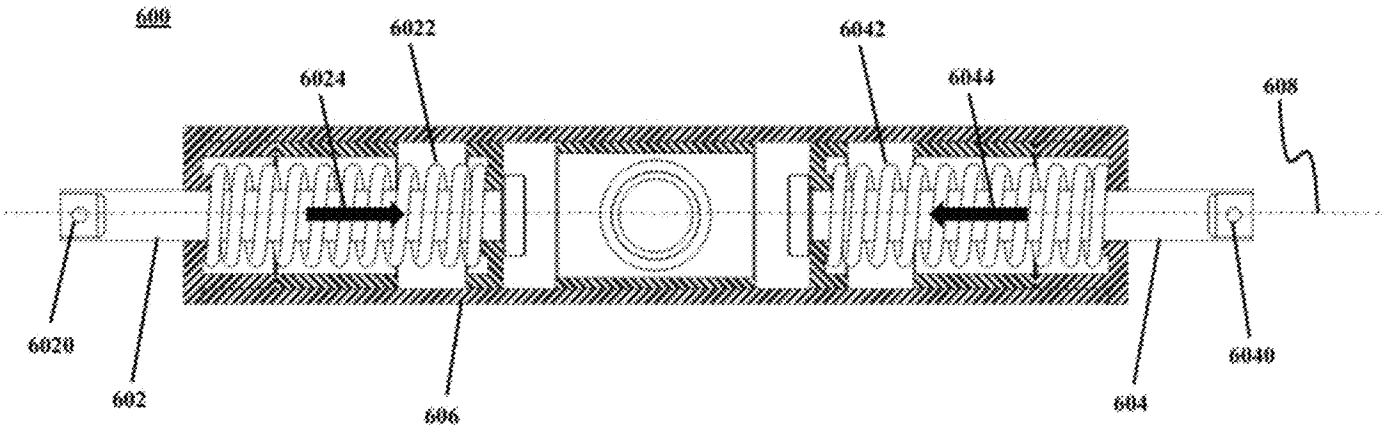
FIG. 6 illustrates a sectional side view of a coupling mechanism, consistent with one or more exemplary embodiments of the present disclosure.

FIG. 6 illustrates a sectional side view of a coupling mechanism 600, consistent with one or more exemplary embodiments of the present disclosure. In an exemplary embodiment, coupling mechanism 600 may be structurally similar to first coupling mechanism 1422*a* and second coupling mechanism 1422*b*. In an exemplary embodiment, coupling mechanism 600 may include two spring-loaded shafts, namely a first spring-loaded shaft 602 and a second spring-loaded shaft 604 that may be movably disposed within a cylinder 606. In an exemplary embodiment, a first end of a linear member such as first linear member 1464*a* or second linear member 1464*b* may be attached to a distal end 6020 of first spring-loaded shaft 602, while a second end of the linear member such as first linear member 1464*a* or second linear member 1464*b* may be attached to a distal end 6040 of second spring-loaded shaft 604. In an exemplary embodiment, first spring-loaded shaft 602 and second spring-loaded shaft 604 may have linear translational movements along a main axis 608 of cylinder 606 in response to forces exerted on first spring-loaded shaft 602 and second spring-loaded shaft 604 by a linear member, such as first linear member 1464*a* or second linear member 1464*b*.

In an exemplary embodiment, first spring-loaded shaft 602 may be loaded by spring 6022 and spring 6022 may exert an inward pretention on first spring-loaded shaft 602 in a direction shown by arrow 6024. In an exemplary embodiment, second spring-loaded shaft 604 may be loaded by spring 6042 and spring 6042 may exert an inward pretention on second spring-loaded shaft 604 in a direction shown by arrow 6044. In exemplary embodiments, such configuration of first spring-loaded shaft 602 and second spring-loaded shaft 604 and inward pretentions exerted on first spring-loaded shaft 602 and second spring-loaded shaft 604 may help prevent slacking of linear members under their own weight.

Referring to FIG. 1D, in an exemplary embodiment, a first end 14640*a* of first linear member 1464*a* may be attached to a first spring-loaded shaft 14220*a* of first coupling mechanism 1422*a* and a second end 14642*a* of first linear member 1464*a* may be attached to a second spring-loaded shaft 14222*a* of first coupling mechanism 1422*a*. In an exemplary embodiment, second linear member 1464*b* may be attached to second coupling mechanism 1422*b* in a similar manner.

In an exemplary embodiment, power generator 144 may include a motor 1440 that may be coupled to a main shaft 1442, where motor 1440 may be configured to drive a rotational movement of main shaft 1442. In an exemplary embodiment, first rotating member 1460*a* may be coupled to a first end 1442*a* of main shaft 1442 and second rotating member 1460*b* may be coupled to a second end 1442*b* of main shaft 1442.

In an exemplary embodiment, first rotating member 1460*a* and second rotating member 1460*b* may include drive sprockets that may be coupled to either end (1442*a* and 1442*b*) of main shaft 1442. In an exemplary embodiment, first idler rotating member 1462*a* and second idler rotating member 1462*b* may include idler sprockets that may be disposed in line with first rotating member 1460*a* and second rotating member 1460*b*. In an exemplary embodiment, first linear member 1464*a* may include a chain that may be extended in a loop around first rotating member 1460*a* and corresponding first idler rotating member 1462*a*. In an exemplary embodiment, second linear member 1464*b* may include a chain that may be extended in a loop around second rotating member 1460*b* and corresponding second idler rotating member 1462*b*.

In an exemplary embodiment, first rotating member 1460*a* and second rotating member 1460*b* may include pulleys that may be coupled to either end (1442*a* and 1442*b*) of main shaft 1442. In an exemplary embodiment, first idler rotating member 1462*a* and second idler rotating member 1462*b* may include idler pulleys that may be disposed in line with first rotating member 1460*a* and second rotating member 1460*b*. In an exemplary embodiment, first linear member 1464*a* may include a belt that may be extended in a loop around first rotating member 1460*a* and corresponding first idler rotating member 1462*a*. In an exemplary embodiment, second linear member 1464*b* may include a belt that may be extended in a loop around second rotating member 1460*b* and corresponding second idler rotating member 1462*b*.

In an exemplary embodiment, first rotating member 1460*a* and second rotating member 1460*b* may include winding rollers that may be coupled to either end (1442*a* and 1442*b*) of main shaft 1442. In an exemplary embodiment, first idler rotating member 1462*a* and second idler rotating member 1462*b* may include dummy rollers that may be disposed in line with first rotating member 1460*a* and second rotating member 1460*b*. In an exemplary embodiment, first linear member 1464*a* may include a rope that may be extended in a loop around first rotating member 1460*a* and corresponding first idler rotating member 1462*a*. In an exemplary embodiment, second linear member 1464*b* may include a rope that may be extended in a loop around second rotating member 1460*b* and corresponding second idler rotating member 1462*b*.

Referring to FIG. 1C, in an exemplary embodiment, flange corner connectors 1210*a-h* may be utilized for connecting head end frame 120, tail end frame 122, top side beams 124, bottom side beams 126, and side cross bracings (128*a* and 128*b*) to form container assembly 12.

Figure 2A:
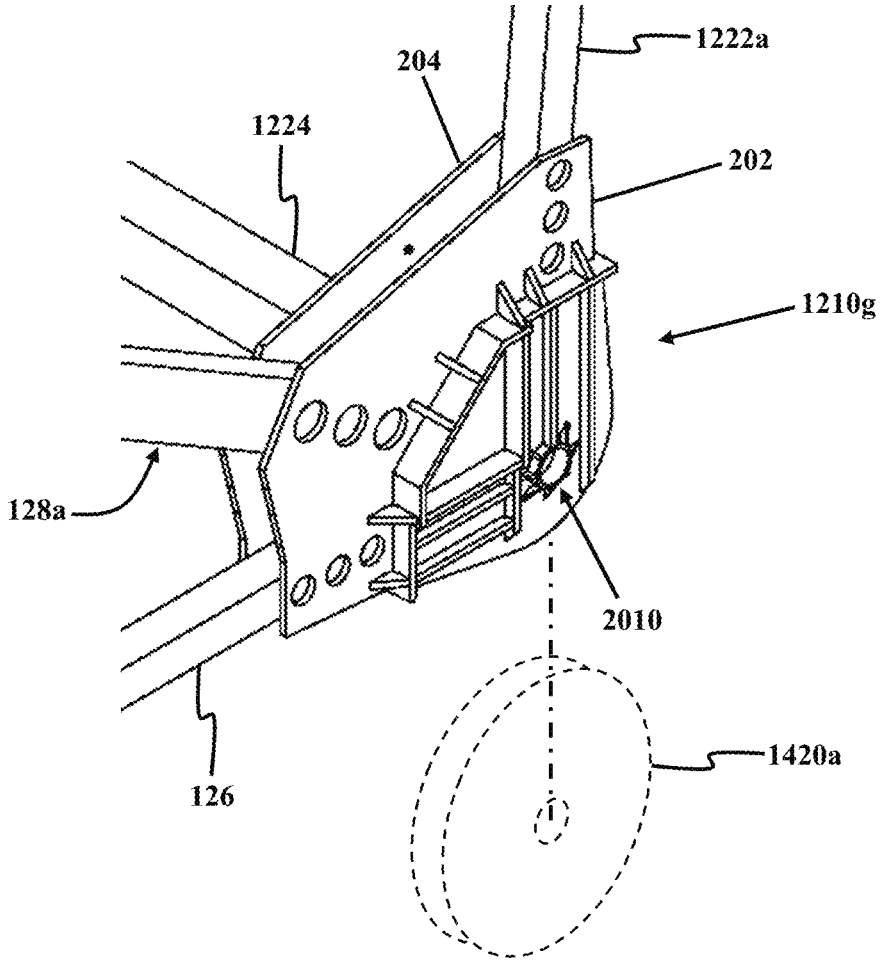
FIG. 2A illustrates an outer view of a flange corner connector, consistent with one or more exemplary embodiments of the present disclosure.
Figure 2B:
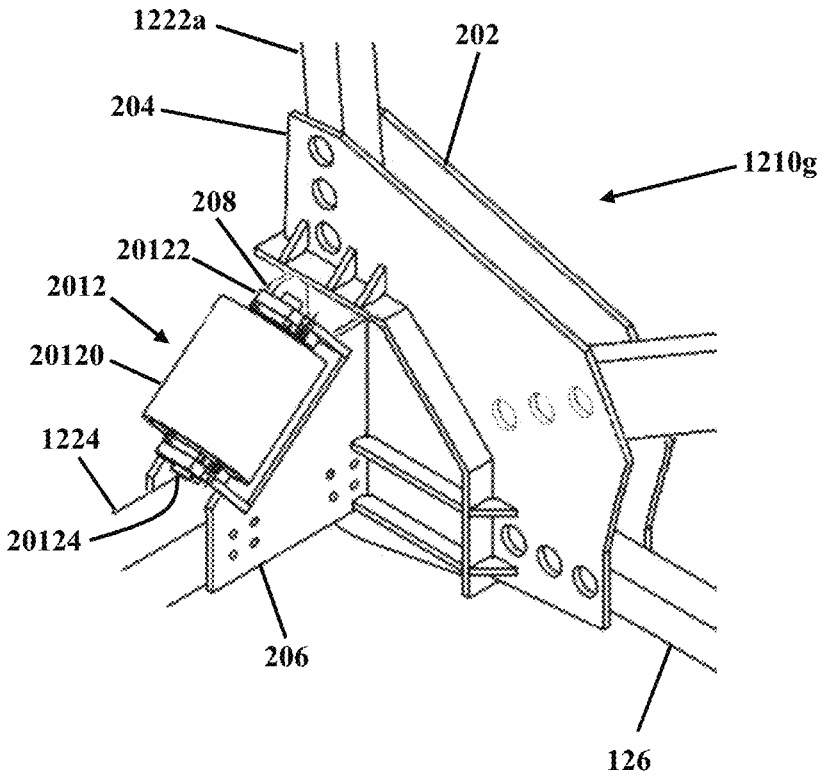
FIG. 2B illustrates an inner view of a flange corner connector, consistent with one or more exemplary embodiments of the present disclosure.

FIG. 2A illustrates an outer view of flange corner connector 1210*g*, consistent with one or more exemplary embodiments of the present disclosure. FIG. 2B illustrates an inner view of flange corner connector 1210*g*, consistent with one or more exemplary embodiments of the present disclosure. In an exemplary embodiment, flange corner connector 1210*g* may include a first main plate 202 and a second main plate 204 that may be utilized for interconnecting tail corner post 1222*a*, bottom side rail 126, and side cross bracing 128*a*. In an exemplary embodiment, first main plate 202 and second main plate 204 may be positioned at either side of each of tail corner post 1222*a*, bottom side rail 126, and side cross bracing 128*a* and may be bolted to tail corner post 1222*a*, bottom side rail 126, and side cross bracing 128*a*.

In an exemplary embodiment, flange corner connector 1210*g* may further include a first connecting plate 206 and a second connecting plate 208 that may be positioned at either side of tail sill 1224 and may be bolted to tail sill 1224 thereby connecting tail sill 1224 to flange corner connector 1210*g*. In an exemplary embodiment, first connecting plate 206 and second connecting plate 208 may be attached to second main plate 204 by methods such as welding. In an exemplary embodiment, first main plate 202 may further include a bearing unit 2010 that may be utilized for rotatably coupling wheel 1420*a* to a respective end of tail sill 1224.

Figure 2C:
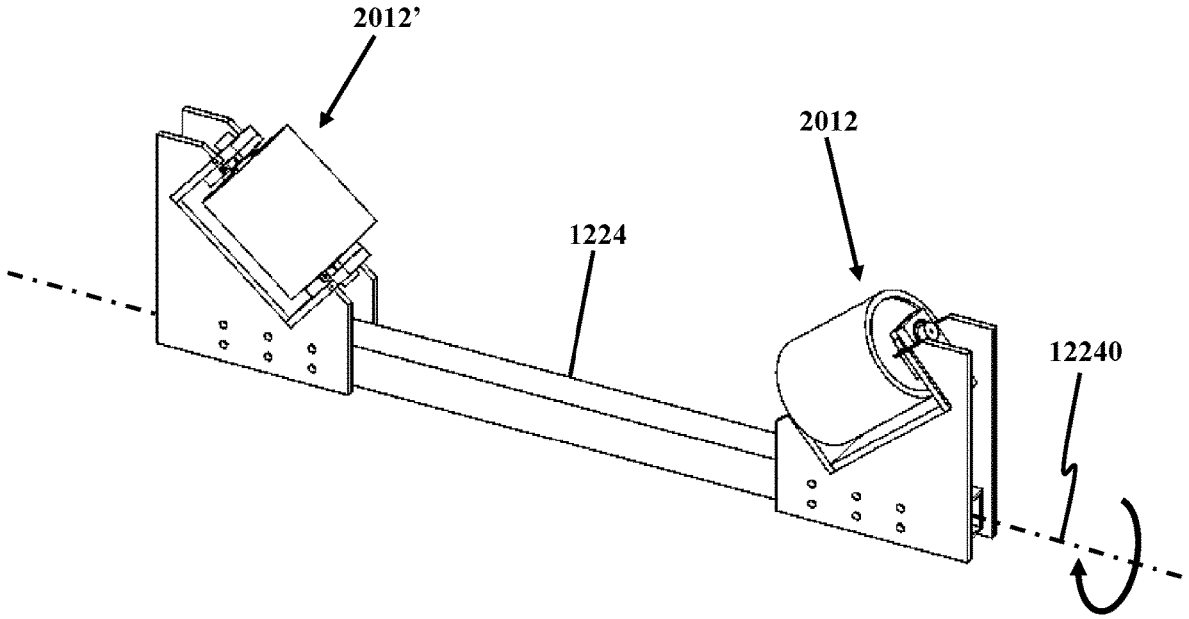
FIG. 2C illustrates two roller assemblies mounted at either end of a tail sill, consistent with one or more exemplary embodiments of the present disclosure.

In an exemplary embodiment, flange corner connector 1210*g* may further include a roller assembly 2012 attached between first connecting plate 206 and second connecting plate 208. In an exemplary embodiment, roller assembly 2012 may include a rolling drum 20120 mounted between a U-shaped bracket 20122 using a pin 20124, where rolling drum 20120 may rotate about its main axis. FIG. 2C illustrates two roller assemblies (2012 and 2012') mounted at either end of tail sill 1224, consistent with one or more exemplary embodiments of the present disclosure.

In an exemplary embodiment, flange corner connector 1210*h* may be similar to flange corner connector 1210*g* and may be utilized for interconnecting tail corner post 1222*b*, bottom side rail 126, side cross bracing 128*b*, and tail sill 1224, as well as rotatably coupling wheel 1420*b* to a respective opposing end of tail sill 1224.

Figure 3A:
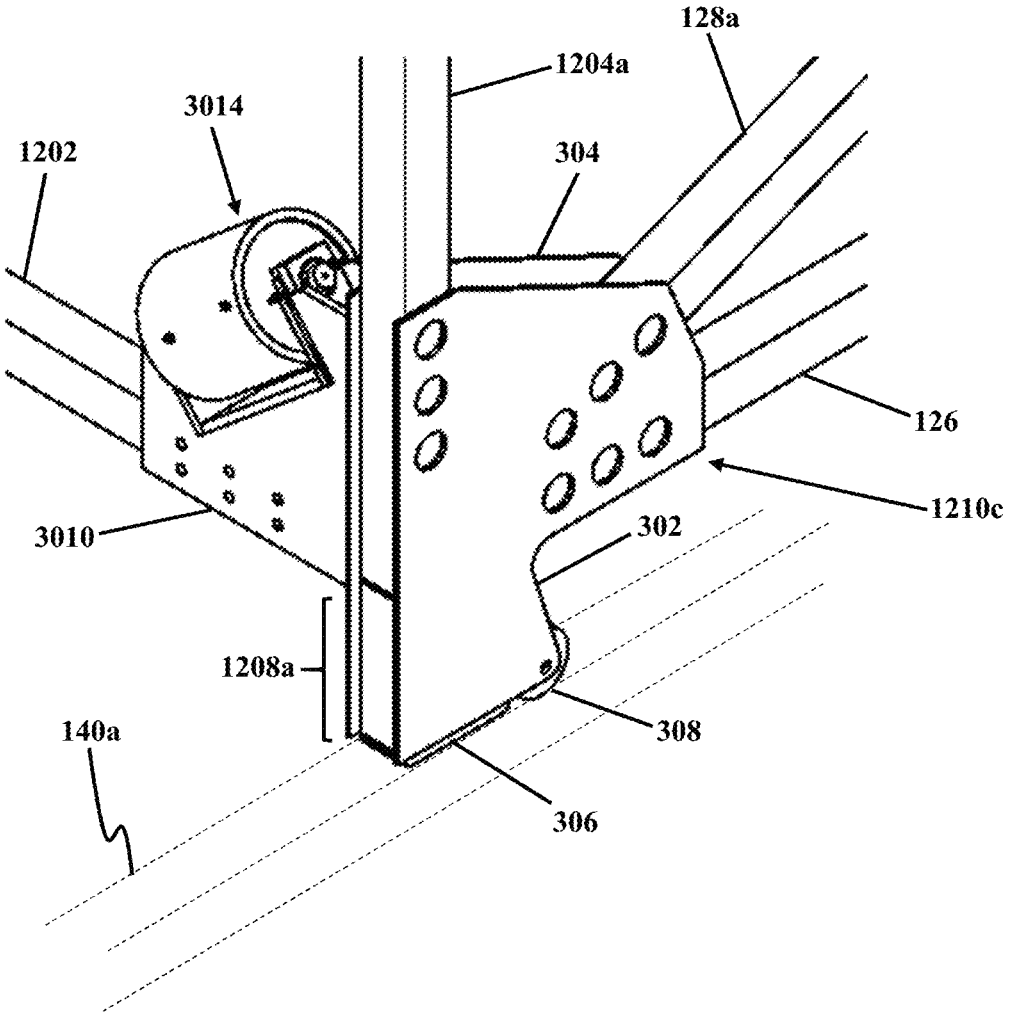
FIG. 3A illustrates an outer view of a flange corner connector, consistent with one or more exemplary embodiments of the present disclosure.
Figure 3B:
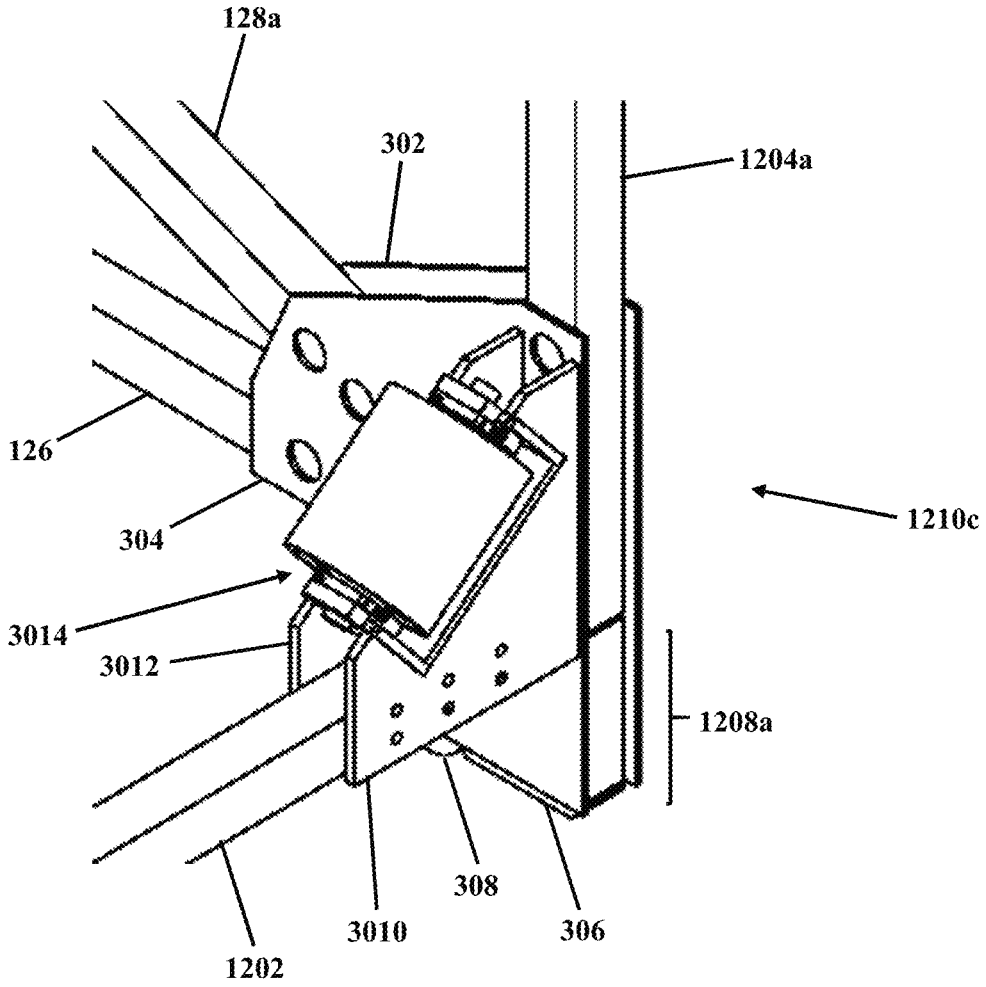
FIG. 3B illustrates an inner view of a flange corner connector, consistent with one or more exemplary embodiments of the present disclosure.

FIG. 3A illustrates an outer view of flange corner connector 1210*c*, consistent with one or more exemplary embodiments of the present disclosure. FIG. 3B illustrates an inner view of flange corner connector 1210*c*, consistent with one or more exemplary embodiments of the present disclosure. In an exemplary embodiment, flange corner connector 1210*c* may include a first main plate 302 and a second main plate 304 that may be utilized for interconnecting head corner post 1204*a*, bottom side rail 126, and side cross bracing 128*a*. In an exemplary embodiment, first main plate 302 and second main plate 304 may be positioned at either side of each of head corner post 1204*a*, bottom side rail 126, and side cross bracing 128*a* and may be bolted to head corner post 1204*a*, bottom side rail 126, and side cross bracing 128*a*.

In an exemplary embodiment, first main plate 302 and second main plate 304 may extend downward beyond bottom side rail 126 and form an extended seat portion 1208*a*. In an exemplary embodiment, extended seat portion 1208*a* may include a seat member 306 that may be a flat member configured to sit on first horizontal guide 140*a* when container assembly 12 is in a horizontal position. In an exemplary embodiment, extended seat portion 1208*a* may further include a rolling wheel 308 that may be rotatably attached between bottom portions of, first main plate 302 and second main plate 304, and may be configured to roll on first horizontal guide 140*a* at the beginning of a rotational movement of container assembly 12.

In an exemplary embodiment, flange corner connector 1210*c* may further include a first connecting plate 3010 and a second connecting plate 3012 that may be positioned at either side of head bottom end beam 1202 and may be bolted to head bottom end beam 1202 thereby connecting head bottom end beam 1202 to flange corner connector 1210*c*. In an exemplary embodiment, first connecting plate 3010 and second connecting plate 3012 may be attached to second main plate 304 by methods such as welding.

Figure 3C:
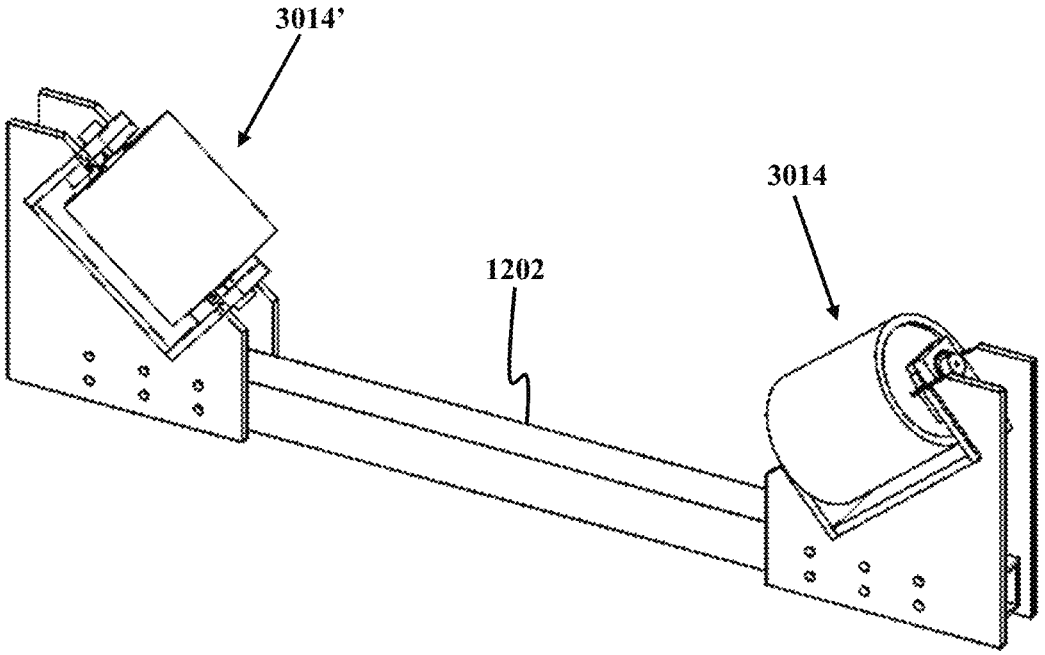
FIG. 3C illustrates two roller assemblies mounted at either end of a head bottom end beam, consistent with one or more exemplary embodiments of the present disclosure.

In an exemplary embodiment, flange corner connector 1210*c* may further include a roller assembly 3014 attached between first connecting plate 3010 and second connecting plate 3012. In an exemplary embodiment, roller assembly 3014 may be similar in construction to roller assembly 2012. FIG. 3C illustrates two roller assemblies (3014 and 3014') mounted at either end of head bottom end beam 1202, consistent with one or more exemplary embodiments of the present disclosure.

In an exemplary embodiment, flange corner connector 1210*d* may be similar to flange corner connector 1210*c* and may be utilized for interconnecting head corner post 1204*b*, bottom side rail 126, and side cross bracing 128*b*.

Figure 4A:
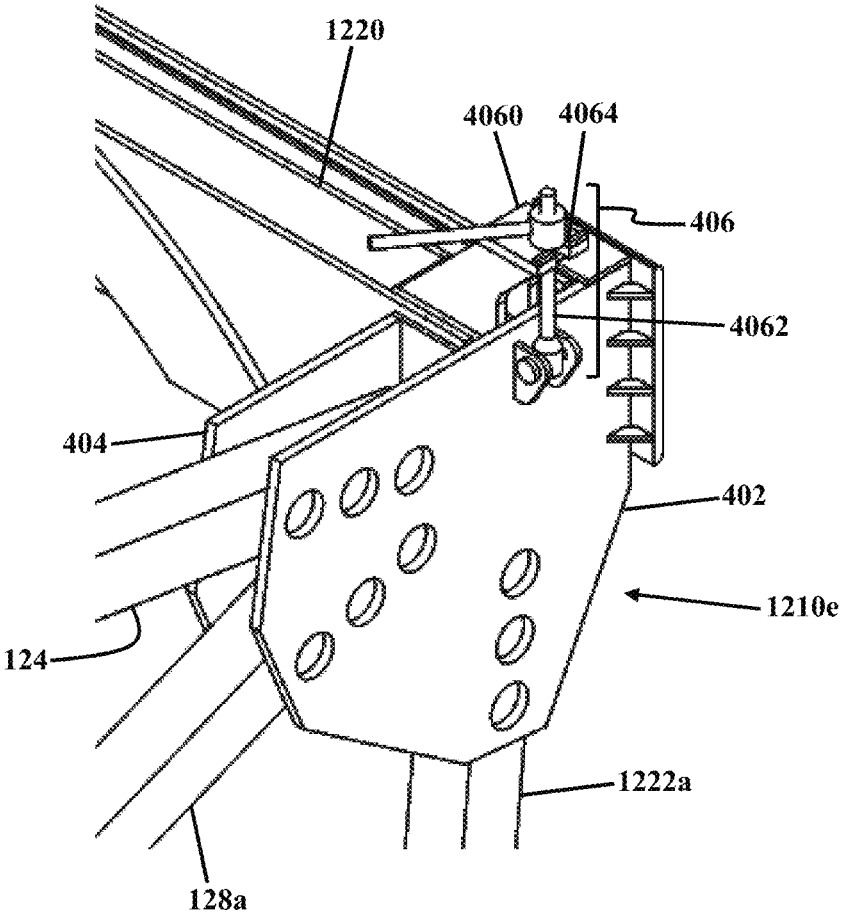
FIG. 4A illustrates an outer view of a flange corner connector, consistent with one or more exemplary embodiments of the present disclosure.
Figure 4B:
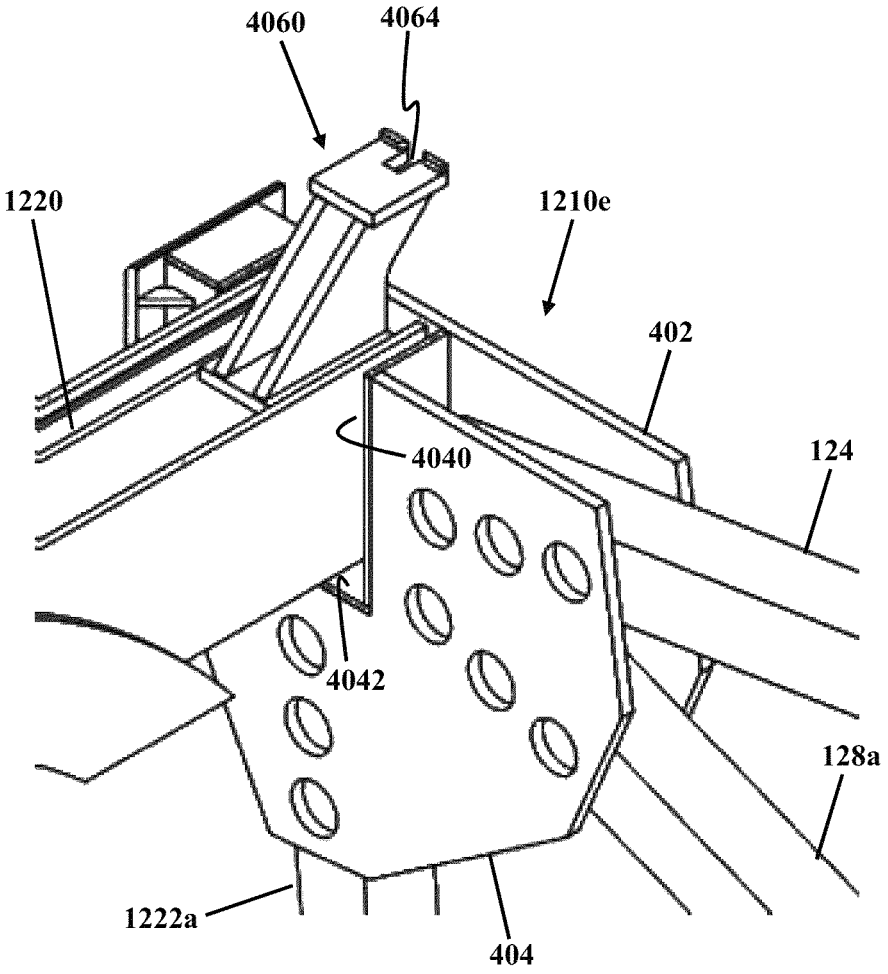
FIG. 4B illustrates an inner view of a flange corner connector, consistent with one or more exemplary embodiments of the present disclosure.

FIG. 4A illustrates an outer view of flange corner connector 1210*e*, consistent with one or more exemplary embodiments of the present disclosure. FIG. 4B illustrates an inner view of flange corner connector 1210*e*, consistent with one or more exemplary embodiments of the present disclosure. In an exemplary embodiment, flange corner connector 1210*e* may include a first main plate 402 and a second main plate 404. Flange corner connector 1210*e* may be utilized for interconnecting tail corner post 1222*a*, top side rail 124, and side cross bracing 128*a*. In an exemplary embodiment, first main plate 402 and second main plate 404 may be positioned at either side of each of tail corner post 1222*a*, top side rail 124, and side cross bracing 128*a*. In an exemplary embodiment, first main plate 402 and second main plate 404 may be bolted to tail corner post 1222*a*, top side rail 124, and side cross bracing 128*a*.

In an exemplary embodiment, second main plate 404 may include a groove 4040 that may be sized to receive a first end of top end removable rail 1220. In an exemplary embodiment, the first end of top end removable rail 1220 may snugly fit within groove 4040. In an exemplary embodiment, groove 4040 may include a support surface 4042 on which the first end of top end removable rail 1220 may be removably positioned and rest. In an exemplary embodiment, a locking mechanism 406 may be utilized for locking the first end of top end removable rail 1220 within groove 4040. In an exemplary embodiment, locking mechanism 406 may include a lock bracket 4060 that may be attached on a top surface of the first end of top end removable rail 1220 and a clamp 4062 that may be attached to first main plate 402. Clamp 4062 may be positioned in a lock groove 4064 on lock bracket 4060 and may be fastened in lock groove 4064 such that locking mechanism 406 may prevent removing the first end of top end removable rail 1220 from groove 4040.

Figure 4C:
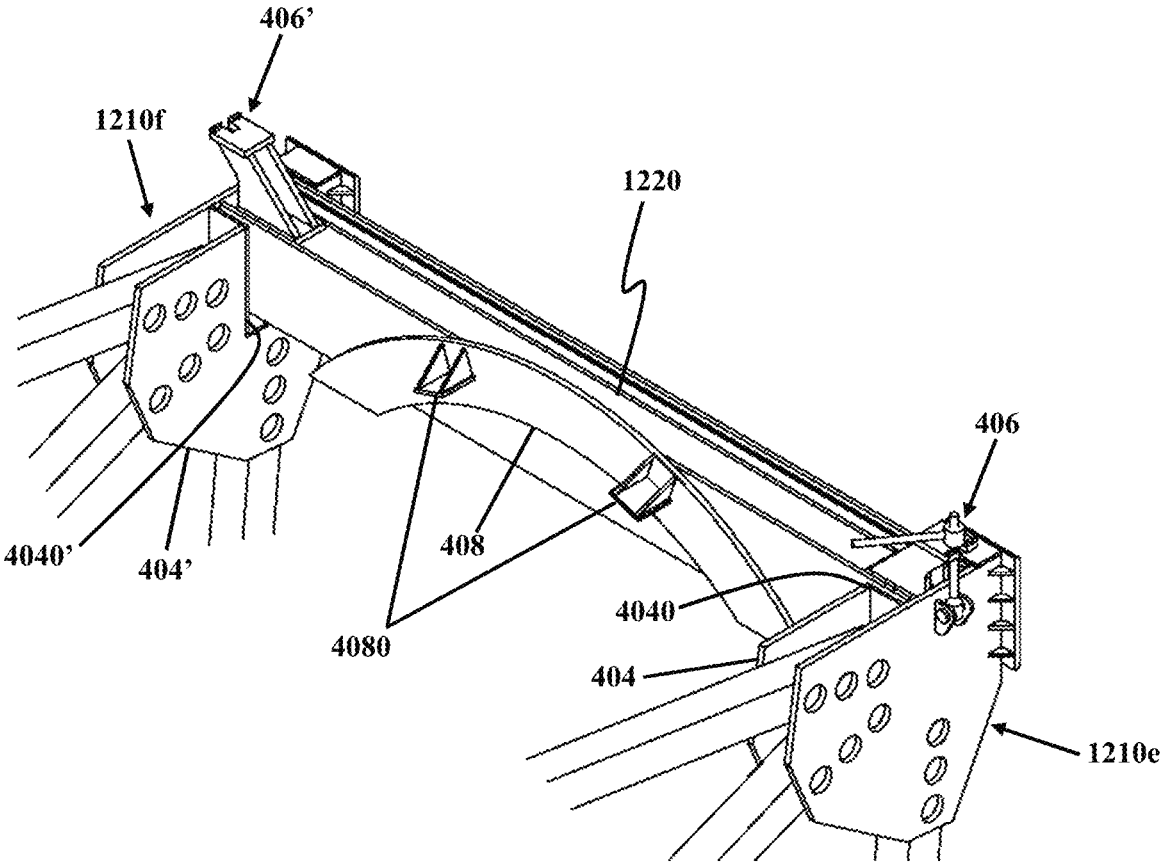
FIG. 4C illustrates a perspective view of a top end removable rail, consistent with one or more exemplary embodiments of the present disclosure.

FIG. 4C illustrates a perspective view of top end removable rail 1220, consistent with one or more exemplary embodiments of the present disclosure. In an exemplary embodiment, flange corner connector 1210*f* may be structurally similar to flange corner connector 1210*e*. In an exemplary embodiment, top end removable rail 1220 may be removably mounted between flange corner connector 1210*e* and flange corner connector 1210*f* such that a first end of top end removable rail 1220 may be locked in groove 4040 of second main plate 404 of flange corner connector 1210*e* utilizing locking mechanism 406 and an opposing second end of top end removable rail 1220 may be locked in a groove 4040' of a second main plate 404' of flange corner connector 1210*f* utilizing locking mechanism 406'. In an exemplary embodiment, second main plate 404' may be structurally similar to second main plate 404, groove 4040' may be similar to grove 4040, and locking mechanism 406' may be structurally similar to locking mechanism 406.

In an exemplary embodiment, a vessel support member 408 may further be attached to top end removable rail 1220 and may be configured for providing support for a bottom end of a vessel that may be secured within container assembly 12. In an exemplary embodiment, vessel support member 408 may be an arc-shaped plate with a couple of protruding support members 4080 attached on a front surface of vessel support member 408.

Figure 5A:
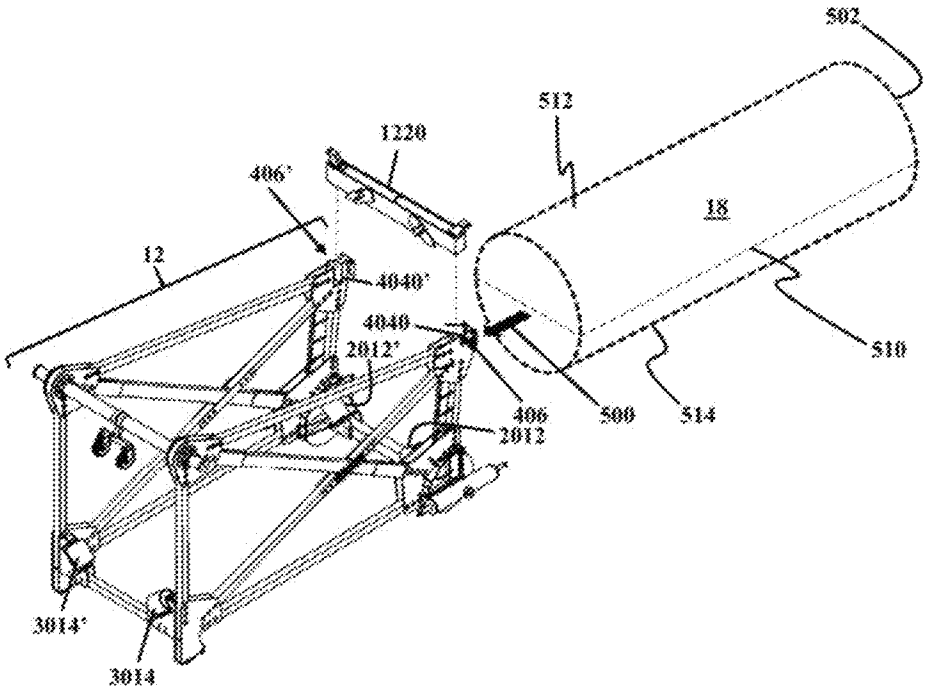
FIG. 5A illustrates a perspective view of a container assembly being loaded with a vessel, consistent with one or more exemplary embodiments of the present disclosure.
Figure 5B:
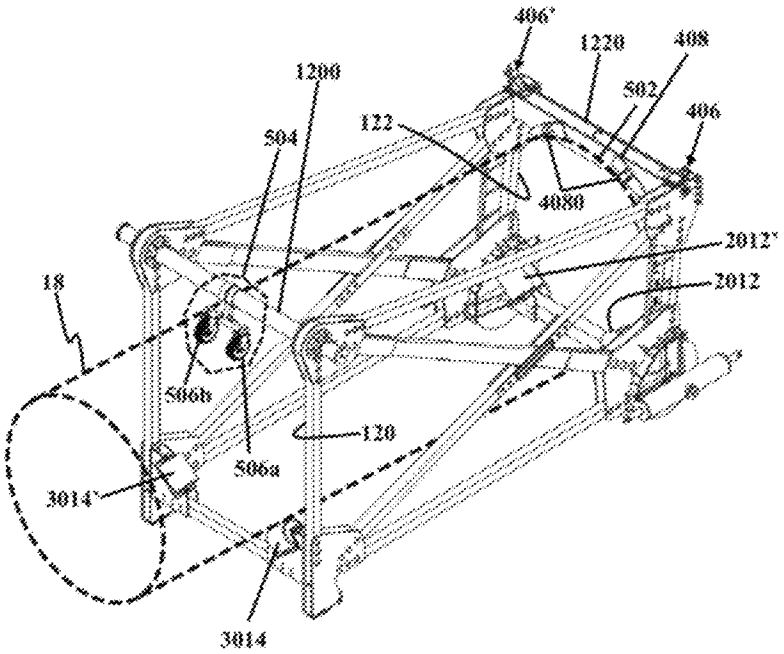
FIG. 5B illustrates a perspective view of a vessel secured within a container assembly, consistent with one or more exemplary embodiments of the present disclosure.
Figure 5C:
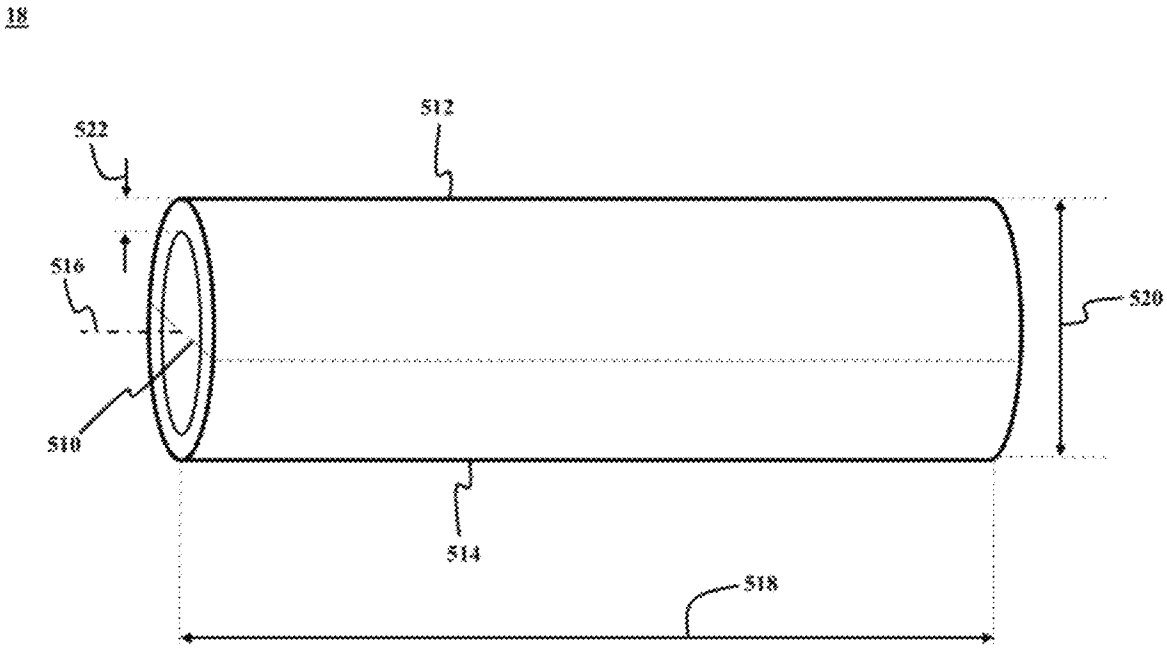
FIG. 5C illustrates a perspective view of a vessel, consistent with one or more exemplary embodiments of the present disclosure.

FIG. 5A illustrates a perspective view of container assembly 12 being loaded with vessel 18, consistent with one or more exemplary embodiments of the present disclosure. FIG. 5B illustrates a perspective view of vessel 18 secured within container assembly 12, consistent with one or more exemplary embodiments of the present disclosure. FIG. 5C illustrates a perspective view of vessel 18, consistent with one or more exemplary embodiments of the present disclosure.

Referring to FIG. 5C, in an exemplary embodiment, vessel 18 may include an elongated pipe section or any similar cylindrical vessel. In an exemplary embodiment, an outer surface of vessel 18 may be divided into an upper outer surface 512 and a lower outer surface 514 by a dividing plane horizontally passing through a main axis 516 of vessel 18. In an exemplary embodiment, vessel 18 may be a pipe section with a length 518 of 3 m to 15 m, a diameter 520 of 1 m to 5 m, and a thickness 522 of 22 mm to 45 mm. In an exemplary embodiment, vessel 18 may weigh up to 60 tons.

In an exemplary embodiment, in order to load vessel 18 inside container assembly 12, top end removable rail 1220 may be unlocked and removed from container assembly 12 and vessel 18 may be moved into container assembly 12 in a direction shown by arrow 500. To this end, in an exemplary embodiment, locking mechanisms 406 and 406' at either end of top end removable rail 1220 may be unlocked and top end removable rail 1220 may be released and moved out of grooves 4040 and 4040'. In an exemplary embodiment, roller assemblies 2012 and 2012' at either end of tail sill 1224 may engage lower outer surface 514 of vessel 18 and may facilitate the movement of vessel 18 into container assembly 12. As used herein, engagement of roller assemblies 2012 and 2012' with lower outer surface 514 of vessel 18 may refer to roller assemblies 2012 and 2012' coming in contact with lower outer surface 514 of vessel 18 such that vessel 18 may slide over roller assemblies 2012 and 2012' while rolling drums of each roller assembly of roller assemblies 2012 and 2012', for example, rolling drum 20120 may roll on lower outer surface 514 of vessel 18.

In an exemplary embodiment, roller assemblies 3014 and 3014' may perform similar functionality as roller assemblies 2012 and 2012' and may facilitate movement of vessel 18 within container assembly 12 as vessel 18 is being loaded into container assembly 12. In an exemplary embodiment, vessel 18 may be placed and secured within container assembly 12 such that an entire length of vessel 18 or a portion of vessel 18 may be placed within container assembly 12. In an exemplary embodiment, once vessel 18 is loaded into container assembly 12 (for example, as shown in FIG. 5B), top end removable rail 1220 may be placed back inside grooves 4040 and 4040' and may be locked in place utilizing locking mechanisms 406 and 406'. In an exemplary embodiment, vessel 18 may be positioned within container assembly 12 such that a bottom end 502 of vessel 18 may be in contact with vessel support member 408 while protruding support members 4080 may be positioned at an outer periphery of bottom base end 502 of vessel 18 in contact with a portion of outer surface of vessel 18 located at the outer periphery of bottom base end 502. In exemplary embodiments, such configurations of vessel support member 408 and protruding support members 4080 may allow for supporting bottom base end 502 of vessel 18 while vessel 18 is being rotated about the main axis of tail sill 1224.

In an exemplary embodiment, container assembly 12 may further include a top rolling mechanism 504 that may be rotatably attached to header beam 1200. In an exemplary embodiment, top rolling mechanism 504 may include at least one roller, for example, top rollers 506*a-b* that may contact upper outer surface 512 of vessel 18. In an exemplary embodiment, vessel 18 may be secured within container assembly 12 such that all rotational and translational movements of vessel 18 may be restrained relative to container assembly 12. In an exemplary embodiment, once vessel 18 is placed within container assembly 12, respective roller assemblies 2012 and 2012' and respective roller assemblies 3014 and 3014' may support lower outer surface 514 of vessel 18 at tail end frame 122 and head end frame 120, respectively. Vessel support member 408 and protruding support members 4080 may support lower base end 502 of vessel 18 while top rolling mechanism 504 supports upper outer surface 512 of vessel 18 at head end frame 120. In exemplary embodiments, such configurations of roller assemblies 2012 and 2012', roller assemblies 3014 and 3014', vessel support member 408, protruding support members 4080, and top rolling mechanism 504 may allow for restraining all rotational and translational movements of vessel 18 relative to container assembly 12 and further prevent any unnecessary movements of vessel 18 during rotational movement of container assembly 12.

Figure 8:
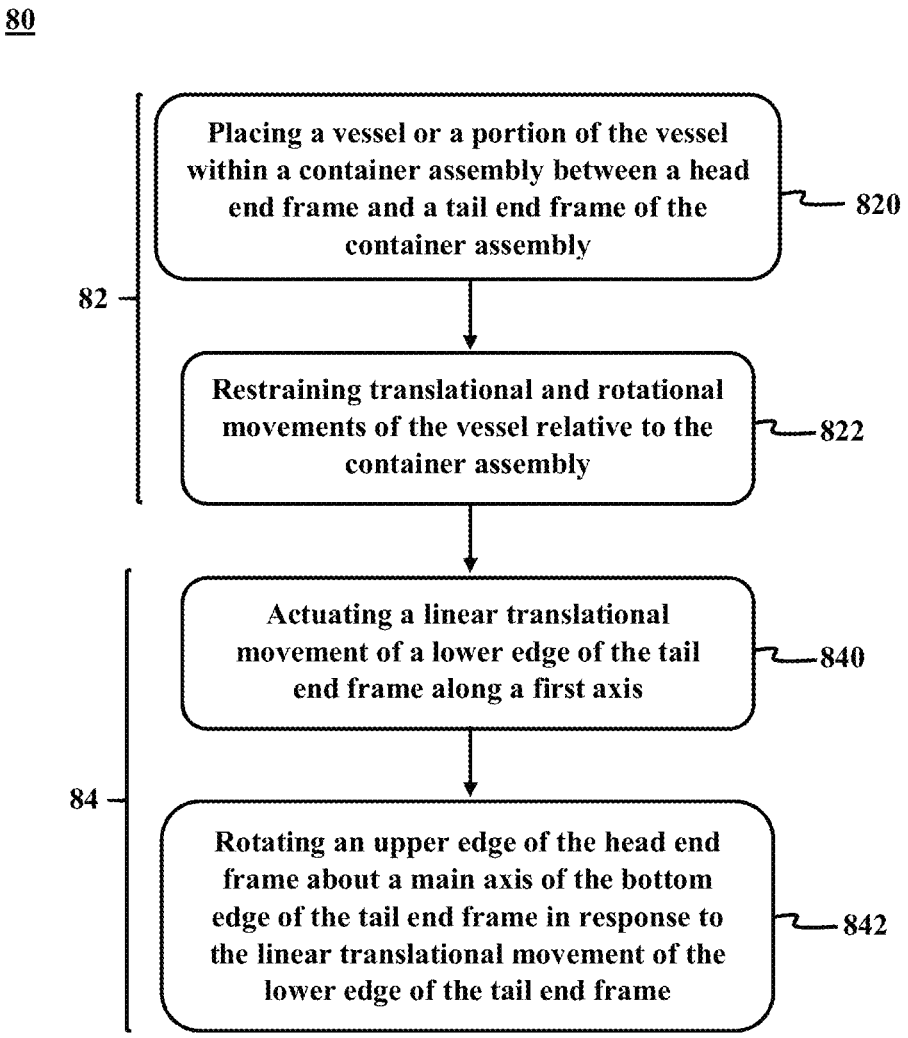
FIG. 8 illustrates a method for rotating a vessel, consistent with one or more exemplary embodiments of the present disclosure.

FIG. 8 illustrates a method 80 for rotating a vessel, consistent with one or more exemplary embodiments of the present disclosure. In an exemplary embodiment, method 80 may be implemented utilizing system 10.

In an exemplary embodiment, method 80 may include a step 82 of securing a vessel or a portion of a vessel within a container assembly, where the container assembly may include a head end frame spaced apart from and interconnected with a tail end frame and a step 84 of rotating the container assembly.

In an exemplary embodiment, step 82 of securing a vessel or a portion of a vessel within a container assembly may include a step 820 of placing the vessel or a portion of the vessel within the container assembly between the head end frame and the tail end frame and a step 822 of restraining translational and rotational movements of the vessel relative to the container assembly.

In an exemplary embodiment, step 84 of rotating the container assembly may include a step 840 of actuating a linear translational movement of a bottom edge of the tail end frame along a first axis and a step 842 of rotating an top edge of the head end frame about a longitudinal axis of the bottom edge of the tail end frame in response to the linear translational movement of the bottom edge of the tail end frame.

Referring to FIGS. 5A and 8, in an exemplary embodiment, step 820 of placing the vessel or a portion of the vessel within the container assembly between the head end frame and the tail end frame may include for example, removing top end removable rail 1220, moving vessel 18 into container assembly 12 utilizing a loader or a crane such that vessel 18 or a portion of vessel 18 may be placed between tail end frame 122 and head end frame 120, and securing top end removable rail 1220 in grooves 4040 and 4040'.

Referring to FIGS. 5B and 8, in an exemplary embodiment, step 822 of restraining translational and rotational movements of the vessel relative to the container assembly may include, for example, restraining translational and rotational movements of vessel 18 by securing bottom end 502 of vessel 18 utilizing vessel support member 408 and protruding support members 4080. Restraining translational and rotational movements of vessel 18 may further include securing an outer surface of vessel 18 between roller assemblies 2012, 2012', 3014, 3014', and top rolling mechanism 504.

Referring to FIGS. 1B and 8, in an exemplary embodiment, step 840 of actuating a linear translational movement of a bottom edge of the tail end frame along a first axis may include, for example, actuating a linear translational movement of tail sill 1224 along first axis 13 utilizing linear actuating mechanism 14.

Referring to FIGS. 1B and 8, in an exemplary embodiment, step 842 of rotating an top edge of the head end frame about a longitudinal axis of the bottom edge of the tail end frame in response to the linear translational movement of the bottom edge of the tail end frame may include, for example, rotating header beam 1200 about longitudinal axis 12240 of tail sill 1224 in response to a linear translational movement of tail sill 1224 along first axis 13. In an exemplary embodiment, step 842 of rotating a top edge of the head end frame about a longitudinal axis of the bottom edge of the tail end frame may include urging header beam 1200 to rotate about longitudinal axis 12240 of tail sill 1224 utilizing double pivot link 16.

In exemplary embodiments, system 10 may allow for rotating a vessel similar to vessel 18 to a desired position without a need for utilizing mobile cranes. In an exemplary embodiment, the exemplary systems and methods such as system 10 and method 80 may address various problems associated with utilizing mobile cranes, such as depending heavily on skills of human operators and impact of human errors. For example, rotational movement of an exemplary container assembly such as container assembly 12 of system 10 may be easily actuated without a need for more than one actuating mechanism, for example, two mobile cranes whose actions must be coordinated by human operators. Container assembly 12 may be easily rotated by structurally coordinated actions of linear actuating mechanism 14 and double pivot link 16 without a need for a human operator to oversee or adjust this coordinated movement, which may significantly reduce human errors and may ensure a smooth rotational movement of a long vessel.

Furthermore, conventional mobile cranes may not be utilized in confined spaces, such as within tunnels. However, the exemplary systems and methods may allow for rotating a long vessel in confined spaces due to low profiles of the exemplary systems.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A system for rotating a vessel, the system comprising:

a container assembly comprising a head end frame and a tail end frame, the head end frame and the tail end frame interconnected utilizing a plurality of side frame members, the container assembly configured to hold the vessel or a portion of the vessel;

a linear actuating mechanism coupled to a bottom edge of the tail end frame, the linear actuating mechanism comprising a motor and a linear actuator connected between the motor and the bottom edge of the tail end frame, the linear actuating mechanism configured to drive a translational movement of the bottom edge of the tail end frame along a first axis, the first axis perpendicular to a longitudinal axis of the bottom edge; and a double-pivot link pivotally connected between a top edge of the head end frame and a fixed revolute joint, the double-pivot link comprising a pair of parallel links, a first end of each link of the pair of parallel links pivotally connected to a corresponding end of the top edge of the head end frame, a second opposing end of each link of the pair of parallel links pivotally connected to the fixed revolute joint, the double-pivot link configured to rotate the top edge about the fixed revolute joint responsive to the translational movement of the bottom edge of the tail end frame along the first axis.

2. The system according to claim 1, wherein the head end frame comprises:

a header beam;

a bottom end beam disposed below and parallel with the header beam; and a pair of head corner posts interconnecting corresponding ends of the header beam and the bottom end beam, wherein, the double-pivot link pivotally connected to either end of the header beam.

3. The system according to claim 2, wherein the first end of each link of the pair of parallel links pivotally connected to a corresponding end of the header beam.

4. The system according to claim 1, wherein the tail end frame comprises:

a top end removable rail;

a tail sill disposed below and parallel with the top end removable rail; and a pair of tail corner posts interconnecting corresponding ends of the top end removable rail and the tail sill, wherein, the linear actuating mechanism coupled to either end of the tail sill.

5. The system according to claim 4, wherein the linear actuating mechanism further comprises:

at least two parallel horizontal guides disposed at either side of the container assembly, the at least two horizontal guides extending along the first axis; and at least two guide couplers, each guide coupler of the at least two guide couplers coupled to a respective horizontal guide of the at least two horizontal guides, each guide coupler configured to move along the respective horizontal guide along the first axis, wherein, each guide coupler of the at least two guide couplers further pivotally coupled to a respective end of the tail sill.

6. The system according to claim 5, wherein the linear actuator is coupled between the motor and the at least two guide couplers, the linear actuator configured to convert the rotational movement of the motor to the linear translational movement of the at least two guide couplers on the at least two parallel horizontal guides along the first axis.

7. The system according to claim 6, wherein the linear actuator comprises:

at least two rotating members disposed at first ends of the at least two horizontal guides, the at least two rotating members coupled to the motor, each rotating member of the at least two rotating members associated with a respective horizontal guide of the at least two horizontal guides, the at least two rotating members configured to be rotated by the motor;

at least two idler rotating members disposed at second opposing ends of the at least two horizontal guides, each idler rotating member of the at least two idler rotating members disposed in line with a corresponding rotating member of the at least two rotating members along the first axis; and at least two linear members, each linear member of the at least two linear members connected between a respective rotating member of the at least two rotating members and a corresponding idler rotating member of the at least two idler rotating members, each linear member of the at least two linear members further coupled to a respective guide coupler of the at least two guide couplers, each linear member of the at least two linear members configured to transmit and convert a rotational movement of a respective rotating member to a translational movement of a respective guide coupler horizontally along the first axis.

8. The system according to claim 4, wherein the head end frame comprises:

a header beam;

a bottom end beam disposed below and parallel with the header beam; and a pair of head corner posts interconnecting corresponding ends of the header beam and the bottom end beam.

9. The system according to claim 8, wherein the plurality of side frame members comprises:

a pair of parallel top side beams interconnecting corresponding ends of the header beam and the top end removable rail; and a pair of parallel bottom side beams interconnecting corresponding ends of the bottom end beam and the tail sill.

10. The system according to claim 1, wherein the linear actuating mechanism further comprises:

at least two parallel horizontal guides disposed at either side of the container assembly, the at least two horizontal guides extending along the first axis; and at least two guide couplers, each guide coupler of the at least two guide couplers coupled to a respective horizontal guide of the at least two horizontal guides, each guide coupler configured to move along the respective horizontal guide along the first axis, wherein, each guide coupler of the at least two guide couplers further pivotally coupled to a respective end of the bottom edge of the tail end frame.

11. The system according to claim 10, wherein the linear actuator is coupled between the motor and the at least two guide couplers, the linear actuator configured to convert the rotational movement of the motor to the linear translational movement of the at least two guide couplers on the at least two parallel horizontal guides along the first axis.

12. The system according to claim 11, wherein the linear actuator comprises:

at least two rotating members disposed at first ends of the at least two horizontal guides, the at least two rotating members coupled to the motor, each rotating member of the at least two rotating members associated with a respective horizontal guide of the at least two horizontal guides, the at least two rotating members configured to be rotated by the motor;

at least two idler rotating members disposed at second opposing ends of the at least two horizontal guides, each idler rotating member of the at least two idler rotating members disposed in line with a corresponding rotating member of the at least two rotating members along the first axis; and at least two linear members, each linear member of the at least two linear members connected between a respective rotating member of the at least two rotating members and a corresponding idler rotating member of the at least two idler rotating members, each linear member of the at least two linear members further coupled to a respective guide coupler of the at least two guide couplers, each linear member of the at least two linear members configured to transmit and convert a rotational movement of a respective rotating member to a translational movement of a respective guide coupler horizontally along the first axis.

13. The system according to claim 12, wherein the linear actuating mechanism further comprises a main shaft extended between the at least two rotating members, the main shaft coupled with the motor, the motor configured to drive a rotational movement of the main shaft.

14. The system according to claim 13, wherein:

the at least two rotating members comprise at least two sprockets coupled to either end of the main shaft, wherein the at least two idler rotating members comprise at least two idler sprockets, and wherein the at least two linear members comprise at least two chains, each chain of the at least two chains extended in a loop around a respective sprocket of the least two sprockets and a corresponding idler sprocket of the at least two idler sprockets.

15. The system according to claim 14, wherein the linear actuator further comprises:

at least two coupling mechanisms, each coupling mechanism of the at least two coupling mechanisms configured to couple a linear member of the at least two linear members to a respective guide coupler of the at least two guide couplers, each coupling mechanism comprising:

a first spring-loaded shaft movably disposed within a cylinder, a first end of the first spring-loaded shaft extending out of a first side of the cylinder, the first end of the first spring-loaded shaft coupled to a first end of the linear member; and a second spring-loaded shaft movably disposed within a cylinder, a first end of the second spring-loaded shaft extending out of a second opposing end of the cylinder, the first end of the second spring-loaded shaft coupled to a second end of the linear member.

16. The system according to claim 13, wherein:

the at least two rotating members comprise at least two pulleys coupled to either end of the main shaft, wherein the at least two idler rotating members comprise at least two dummy pulleys, and wherein the at least two linear members comprise at least two belts, each belt of the at least two belts extended in a loop around a respective pulley of the least two pulleys and a corresponding dummy pulley of the at least two dummy pulleys.

17. The system according to claim 13, wherein:

the at least two rotating members comprise at least two winding rollers coupled to either end of the main shaft, wherein the at least two idler rotating members comprise at least two idler rollers, and wherein the at least two linear members comprise at least two ropes, each rope of the at least two ropes extended in a loop around a respective winding roller of the least two winding rollers and a corresponding idler roller of the at least two idler rollers.

18. The system according to claim 1, wherein the revolute joint comprises a pair of pin joints and the opposing second end of each link of the pair of parallel links pivotally coupled with a respective pin joint of the pair of pin joints.

19. A method for rotating a vessel, the method comprising:

placing the vessel or a portion of the vessel within a container assembly, the container assembly comprising a head end frame and a tail end frame, the head end frame and the tail end frame interconnected utilizing a plurality of side frame members;

restraining translational and rotational movements of the vessel relative to the container assembly;

actuating a linear movement of a bottom edge of the tail end frame along a first axis, the first axis perpendicular to a longitudinal axis of the bottom edge; and rotating a top edge of the head end frame about the longitudinal axis of the bottom edge responsive to the linear movement of the bottom edge of the tail end frame along the first axis.

* * * * *